US011441231B2

(12) United States Patent
Zhou et al.

(10) Patent No.: US 11,441,231 B2
(45) Date of Patent: Sep. 13, 2022

(54) METHOD FOR SURFACE TREATMENT OF MATTE TINPLATED PRODUCT

(71) Applicant: KUNSHAN YIDING INDUSTRIAL TECHNOLOGY CO., LTD, Jiangsu (CN)

(72) Inventors: Aihe Zhou, Jiangsu (CN); Meishu Kadomatsu, Jiangsu (CN)

(73) Assignee: KUNSHAN YIDING INDUSTRIAL TECHNOLOGY CO., LTD, Jiangsu (CN)

( * ) Notice: Subject to any disclaimer, the term of this patent is extended or adjusted under 35 U.S.C. 154(b) by 0 days.

(21) Appl. No.: 17/298,030

(22) PCT Filed: Sep. 3, 2020

(86) PCT No.: PCT/CN2020/113176

§ 371 (c)(1),
(2) Date: May 28, 2021

(87) PCT Pub. No.: WO2021/052182

PCT Pub. Date: Mar. 25, 2021

(65) Prior Publication Data

US 2022/0098748 A1 Mar. 31, 2022

(30) Foreign Application Priority Data

Sep. 19, 2019 (CN) ..... 201910886202.3

(51) Int. Cl.

| | |
|---|---|
| ***C25D 5/50*** | (2006.01) |
| ***C25D 5/52*** | (2006.01) |
| ***H01R 43/16*** | (2006.01) |
| ***H01R 13/03*** | (2006.01) |

(52) U.S. Cl.
CPC ..... *C25D 5/505* (2013.01); *C25D 5/52* (2013.01); *H01R 43/16* (2013.01); *H01R 13/03* (2013.01); *H05B 2203/032* (2013.01)

(58) Field of Classification Search
None
See application file for complete search history.

(56) References Cited

U.S. PATENT DOCUMENTS

| | | | | |
|---|---|---|---|---|
| 2004/0056068 | A1* | 3/2004 | Rae | B23K 1/0053 228/9 |
| 2008/0308300 | A1* | 12/2008 | Conti | C25D 5/34 174/250 |
| 2014/0110402 | A1 | 4/2014 | Clemen, Jr. | |

FOREIGN PATENT DOCUMENTS

| | | |
|---|---|---|
| CN | 101283119 | 10/2008 |
| CN | 106392384 | 2/2017 |
| CN | 110512244 | 11/2019 |

(Continued)

OTHER PUBLICATIONS

"International Search Report (Form PCT/ISA/210) of PCT/CN2020/113176", dated Dec. 1, 2020, with English translation thereof, pp. 1-4.

(Continued)

*Primary Examiner* — Louis J Rufo
(74) *Attorney, Agent, or Firm* — JCIP Global Inc.

(57) ABSTRACT

A method for surface treatment of a matte tin-plated product, which is configured for heating the matte tin electroplated on a surface of the product into a bright tin. The method for surface treatment includes heating the surface of the matte tin-plated product with infrared rays.

8 Claims, 24 Drawing Sheets

(56) References Cited

FOREIGN PATENT DOCUMENTS

| | | | |
|---|---|---|---|
| JP | S57126992 | | 8/1982 |
| JP | 2008019468 | | 1/2008 |
| JP | 4889422 | | 3/2012 |
| JP | 5337760 | | 11/2013 |
| JP | 2015150612 | | 8/2015 |
| JP | 2015150612 A | * | 8/2015 |
| JP | 2017027674 | | 2/2017 |

OTHER PUBLICATIONS

Chubu Bureau of Economy, Trade and Industry, "Development of tin-plated whiskers suppression technology by high-frequency induction heating reflow processing (Reflow processing process shortening, energy saving)," Summary of Research and Development Results Report of Strategic Fundamental High-tech Projects, Mar. 2012, pp. 1-26.

* cited by examiner

METHOD FOR SURFACE TREATMENT OF MATTE TINPLATED PRODUCT

CROSS-REFERENCE TO RELATED APPLICATION

This application is a 371 of international application of PCT application serial no. PCT/CN2020/113176, filed Sep. 3, 2020, which claims the priority benefit of China application no. 201910886202.3, filed on Sep. 19, 2019. The entirety of each of the above mentioned patent applications is hereby incorporated by reference herein and made a part of this specification.

TECHNICAL FIELD

The present disclosure relates to the technical field of electroplating, and in particular, to a method for surface treatment of a matte tin-plated product.

BACKGROUND

With the miniaturization and microminiaturization of electronic products, connectors for circuit boards are becoming more and more miniaturized and microminiaturized, which requires raw material terminals of the connectors to be increasingly miniaturized and microminiaturized. Due to decreasing distances between the connector terminals, tin whiskers growing from tin-plated products will cause short circuits, making the products fail to meet the design requirements. In order to solve the problem of tin whiskers on tin-plated products of micro continuous terminals, a Reflow process of converting matte tin into bright tin by heating the surface of a matte tin-plated product has been continuously developed.

Patent Document 1 (Japanese Patent No. 5337760) describes in detail that when a matte tin-plated product is placed at room temperature, whisker-like metallic tin, called tin whiskers, will grow on the tin-plated surface over time. To prevent the growth of tin whiskers, it is a well-known technology to convert matte tin into bright tin by heating, that is, by means of a Reflow process, after a matte tin-plated product is obtained from a continuous electroplating production line. However, although the Reflow process has a good inhibitory effect on the growth of tin whiskers, improper implementation of the Reflow process will cause discoloration or oxidation on the tin surface. In addition, after the Reflow process is performed on the electroplated matte tin with uniform thickness, the molten tin on the terminal surface is drawn to the center of the terminal, so that the tin coating becomes thicker at the center of the terminal and thinner at two ends, resulting in non-uniform thickness of the tin coating on the terminal surface. It can be observed with a microscope that the tin surface is uneven or wavy. In severe cases, the underplated metal will be exposed and the soldering performance is affected.

Patent Document 2 (Japanese Patent Publication No. JP 2008-019468 A) describes that when a Reflow process is performed on an electroplated terminal by means of hot-air circulation or electric heat radiation, an intermetallic compound is formed between an underplated metal such as copper or nickel and the surface metallic tin, to relieve the stress in the tin coating and inhibit the growth of tin whiskers. However, an oxide film formed on the tin surface during the Reflow process reduces the soldering performance. In addition, the flow of molten tin during the Reflow process results in non-uniform thickness of the tin coating.

Patent Document 3 (Japanese Patent No. 4889422) describes that when a Reflow process is performed by means of superheated steam, the air around the product is thin and the oxygen concentration is relatively low, which prevents the oxidation of tin; and as the superheated steam has good thermal conductivity and thermal potential, the tin surface can be partially melted, so that for products with complex shapes, it is possible to control the formation of alloy compounds between tin and the underplated metal.

Patent Document 4 (Japanese Patent Publication No. JP 2015-150612 A) introduces that a Reflow process is performed based on the combination of three separated heating zones. Quartz heaters are used for preheating in a first heating zone; non-infrared heaters are used for uniform heating in a second heating zone; and infrared heaters are used in a third heating zone and are divided into two parts, wherein a plurality of infrared heaters are arranged from low to high in the horizontal direction in a first part and a plurality of infrared heaters are arranged from left to right in the vertical direction in a second part. The infrared heaters at different positions are selected to heat matte tin-plated products according to Reflow processing conditions of the products. Compared with heating by means of hot-air blowers and superheated steam, the infrared heating used in the third heating zone heats up the products faster. However, when matte tin-plated products of micro continuous terminals, for example, a series of matte tin-plated products of terminals that are less than 10 mm wide and have a tin-plated pin region for soldering of 2-9 mm are to be heated into bright tin, according to the heat treatment device and method provided in this Patent Document, since the treatable material width is limited to 30-300 mm, when heat treatment is performed on the matte tin-plated products of micro continuous terminals, it is impossible to selectively heat narrow matte tin-plated regions; meanwhile, the gold-plated part in a conductive functional region will be heated by infrared rays, which may cause discoloration of gold in the conductive functional region at high temperatures or cause migration of the underplated metal to the gold-plated surface at high temperatures and thus affect the conductivity of the gold coating.

Patent Document 5 (Japanese Patent Publication No. JP 2017-027674 A) provides a high-frequency induction heating apparatus that performs a Reflow process by means of high-frequency induction in the air or a liquid. The heating of the surface of a matte tin-plated product with high-frequency induction is a process in which a current induced by the action of a high-frequency magnetic field causes self-heating of a conductor. The high-frequency induction heats up the product fast and can rapidly convert electroplated matte tin into bright tin, thereby reducing the oxidation time of tin in the air. Compared with heating by means of hot-air circulation, the high-frequency induction heating is faster and the oxidation time of metallic tin in the air is reduced. Non-Patent Document 1 (Summary of Research and Development Results Report of Strategic Fundamental High-tech Projects Sponsored in 2011, by Chubu Bureau of Economy, Trade and Industry in Japan) describes that the coating thickness of a tin-plated terminal before heat treatment is uniform and is irrelevant to the position of the terminal. After a Reflow process is performed by using the high-frequency induction apparatus in the air, the tin coating becomes much thicker at the center of the terminal and thinner at two ends, which is caused by the fact that the tin melted by high-frequency induction is drawn to the center of the terminal due to the influence of surface tension.

In view of the above, matte tin-plated products can be heated in different ways, which solves the problem of short circuits caused by the tin-plated products to a certain extent. However, after the matte tin-plated products are heated to form bright tin, the problem of non-uniform thickness of the tin coating due to various reasons has become an issue in urgent need of solutions.

SUMMARY

The objective of the present disclosure is to at least solve one of the technical problems in the prior art.

Therefore, the present disclosure provides a method for surface treatment of a matte tin-plated product. The method is easy to implement and has advantages such as large heating power, precise temperature control, and product quality improvement.

The method for surface treatment of the matte tin-plated product according to an embodiment of the present disclosure is configured for heating the matte tin electroplated on a surface of the product into bright tin. The method for surface treatment includes heating the surface of the matte tin-plated product with infrared rays.

The method for surface treatment of the matte tin-plated product according to the embodiment of the present disclosure includes heating the surface of the matte tin-plated product with infrared rays. The method can not only heat the matte tin electroplated on the surface of the product into bright tin by using the infrared radiation energy and precisely control the temperature, but also can improve the uniformity of the thickness of the tin coating and has advantages such as high heating efficiency and high heating speed.

According to an embodiment of the present disclosure, the infrared rays are emitted by an infrared radiator.

According to an embodiment of the present disclosure, the infrared radiator includes a plurality of heating zones arranged at intervals, and the method for surface treatment includes: S1: setting a movement path of the matte tin-plated product according to a position of the infrared radiator, the movement path including a waiting position and a heating position; Step S2: placing the matte tin-plated product at the waiting position, and allowing a side of the matte tin-plated product to be heated to face the infrared radiator; and Step S3: turning on the infrared radiator for preheating, and controlling the matte tin-plated product to sequentially pass through the plurality of heating zones along the movement path to undergo partial heating and then be transported out.

According to an embodiment of the present disclosure, two infrared radiators are provided, the two infrared radiators are arranged facing each other and each of the two infrared radiators is provided with the plurality of heating zones arranged at intervals along a length direction of the movement path, and in Step S1, the movement path is located between the two infrared radiators, and matte tin is electroplated on two sides of the matte tin-plated product.

According to an embodiment of the present disclosure, the two infrared radiators are symmetrically arranged on two sides of the movement path.

According to an embodiment of the present disclosure, in Step S3, the two infrared radiators are turned on to heat the two sides of the matte tin-plated product simultaneously.

According to an embodiment of the present disclosure, Step S3 further includes: before turning on the infrared radiator for preheating, presetting a heating temperature of each of the plurality of heating zones in the infrared radiator.

According to an embodiment of the present disclosure, the plurality of heating zones have heating temperatures that increase sequentially.

According to an embodiment of the present disclosure, in Step S3, the matte tin-plated product is controlled to move at a constant speed along the movement path.

According to an embodiment of the present disclosure, in Step S3, the matte tin-plated product in each of the plurality of heating zones is heated to a predetermined temperature for a time period of less than 1 s.

The additional aspects and advantages of the present disclosure will be partially given in the following description, and will partially become obvious from the following description or be understood through the practice of the present disclosure.

BRIEF DESCRIPTION OF THE DRAWINGS

The above and/or additional aspects and advantages of the present disclosure will become obvious and easy to understand from the description of the embodiments with reference to the following drawings.

Figure 1:
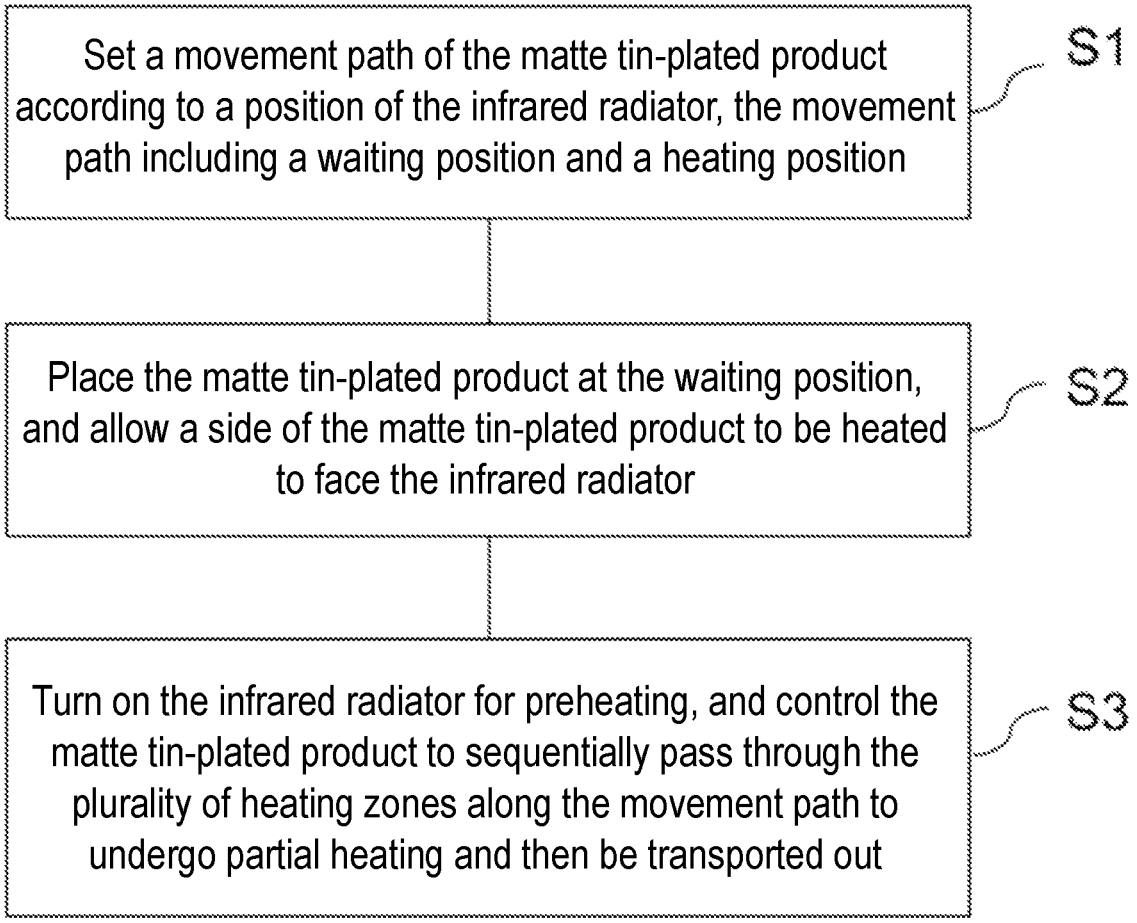
FIG. 1 is a schematic flowchart of a method for surface treatment of a matte tin-plated product according to an embodiment of the present disclosure.

REFERENCE NUMERALS infrared radiator 20; infrared radiant tube 23; matte tin-plated product 200.

DETAILED DESCRIPTION OF THE EMBODIMENTS

Embodiments of the present disclosure are described in detail below and are exemplified in the accompanying drawings, wherein the same or similar reference signs indicate the same or similar elements or elements with the same or similar functions. The embodiments described below with reference to the accompanying drawings are exemplary and are intended to explain the present disclosure, instead of limiting the present disclosure.

In the description of the present disclosure, it should be understood that terms such as "central", "longitudinal", "transverse", "length", "width", "thickness", "upper", "lower", "front", "back", "left", "right", "vertical", "horizontal", "top", "bottom", "inner", "outer", "clockwise", "anticlockwise", "axial", "radial", and "circumferential" indicate directional or positional relationships based on the accompanying drawings. They are merely used for the convenience and simplicity of the description of the present disclosure, instead of indicating or implying that the demonstrated device or element is located in a specific direction or is constructed and operated in a specific direction. Therefore, they cannot be construed as limitations to the present disclosure. Moreover, a feature defined by "first" or "second" explicitly or implicitly includes one or more such features. In the description of the present disclosure, "a plurality of" means two or above two, unless otherwise stated.

In the description of the present disclosure, it should be noted that unless otherwise expressly specified and defined, terms such as "mounted", "interconnected", and "connected" should be understood in a broad sense. For example, they may be fixed connections, detachable connections, or integral connections; may be mechanical connections or electrical connections; may be direct connections or indirect connections through an intermediate medium; and may be internal communications between two elements. The specific meanings of the above terms in the present disclosure can be understood by persons of ordinary skill in the art according to specific situations.

A method for surface treatment of a matte tin-plated product according to an embodiment of the present disclosure is described in detail below with reference to the accompanying drawings.

The method for surface treatment of the matte tin-plated product according to the embodiment of the present disclosure is configured for heating the matte tin electroplated on a surface of the product into bright tin. The method for surface treatment includes heating the surface of the matte tin-plated product 200 with infrared rays.

In other words, the method for surface treatment of the matte tin-plated product according to the embodiment of the present disclosure is to irradiate infrared rays onto the surface of the matte tin-plated product 200, so that the matte tin electroplated on the surface of the product can be heated into bright tin by means of infrared radiation from an infrared heat source. The infrared rays heat up the product fast and can reach a set temperature in 1 s at a maximum speed. The thermal efficiency is high, and it is safe and reliable to use and has strong practicability.

In the method for surface treatment according to the embodiment of the present disclosure, raw materials to be electroplated may be strips of copper, copper alloy, stainless steel and the like, and may also be continuous terminals made from these strips by stamping. These strips and continuous terminals go through a continuous electroplating production line to be entirely electroplated with copper or nickel coatings and then electroplated with matte tin on specified regions. Besides matte tin, gold or the like can also be electroplated on a conductive functional region according to different product requirements. The strip or continuous terminal has a thickness of 0.1 mm-0.8 mm and a width of 6 mm-10 mm, the copper coating has a thickness of 0.7 μm-1.3 μm, the nickel coating has a thickness of 1.3 μm-2.5 μm, and the matte tin coating has a thickness of 1.0 μm-3.5 μm.

In addition, the matte tin-plated product 200 of the strip or terminal in a micro region according to the embodiment of the present disclosure may be obtained by electroplating with a sulfate solution or with a methanesulfonate solution.

According to an embodiment of the present disclosure, infrared rays are emitted by an infrared radiator, which is convenient to use. Preferably, the infrared radiator 20 according to the embodiment of the present disclosure emits short-wave infrared rays with the highest radiation intensity and a wavelength of 1.2 μm-2 μm.

Further, the infrared radiator 20 includes a plurality of heating zones arranged at intervals. The method for surface treatment includes: Step S1: setting a movement path of the matte tin-plated product 200 according to a position of the infrared radiator 20, the movement path including a waiting position and a heating position; Step S2: placing the matte tin-plated product 200 at the waiting position, and allowing a side of the matte tin-plated product 200 to be heated to face the infrared radiator 20; and Step S3: turning on the infrared radiator 20 for preheating, and controlling the matte tin-plated product 200 to sequentially pass through the plurality of heating zones along the movement path to undergo partial heating and then be transported out. Specifically, the infrared radiator 20 may include a plurality of heating zones, the infrared radiator 20 may be arranged on at least one side of the movement path, at least one heating position may be set on the movement path, and at least one heating zone may be set at each heating position. When the matte tin-plated product 200 passes through each heating position along the movement path, the part of the matte tin-plated product 200 corresponding to the heating zone can be heated by infrared radiation.

The infrared radiator 20 may have a plurality of heating zones arranged along a direction perpendicular to a length direction of the movement path, and the plurality of heating zones are corresponding to the parts of the matte tin-plated product 200 extending in a height direction. In other words, when the matte tin-plated product 200 moves to corresponding heating positions, the plurality of heating zones corresponding to the parts of the matte tin-plated product 200 along the height direction can be selectively turned on or off, so that the plurality of heating zones along the height direction of the matte tin-plated product 200 can be selected to achieve specific purposes. It should be noted that, the infrared radiator 20 may also have a plurality of heating zones arranged along the length direction of the movement path. When moving along the movement path, the matte tin-plated product 200 sequentially passes through the plurality of heating zones and the same or different parts thereof can be heated.

According to an embodiment of the present disclosure, the matte tin-plated product 200 may be formed into a plate-shaped member with a length extending along the movement path.

In some specific embodiments of the present disclosure, the heating zone may be linear and extend in a direction parallel, perpendicular, or oblique to the heating path, which can be specifically determined according to the shape of the matte tin-plated product 200. The heating zone may also be circular or in other shapes. In comparison, the infrared radiator 20 with linear heating zones is more convenient to install and has a larger coverage of radiation and higher heating efficiency.

According to an embodiment of the present disclosure, the infrared radiator 20 may include a plurality of infrared radiant tubes 23. The plurality of infrared radiant tubes 23 in the heating zone may be distributed at intervals in the vertical direction or distributed at intervals in the horizontal direction. Each infrared radiant tube 23 can heat a corresponding part of the product 200 that passes through. Optionally, the plurality of infrared radiant tubes 23 in the heating zone may be arranged parallel, perpendicular, or oblique to the heating path, which facilitates installation and enables more infrared radiant tubes 23 to be installed within a limited space.

According to an embodiment of the present disclosure, two infrared radiators 20 are provided, the two infrared radiators 20 are arranged facing each other and each of the two infrared radiators 20 has a plurality of heating zones arranged at intervals along the length direction of the movement path, and in Step S1, the movement path is located between the two infrared radiators 20, and matte tin is electroplated on two sides of the matte tin-plated product 200. In other words, the two sides of the matte tin-plated product 200 can be heated with infrared rays simultaneously, to achieve simultaneous heating of both internal and external sides.

In some specific embodiments of the present disclosure, the two infrared radiators 20 are symmetrically arranged on two sides of the movement path to improve the uniformity of tin plating. Matte tin is electroplated on two sides of the matte tin-plated product 200, and at least one of the two infrared radiators 20 can be selectively turned on according to the actual situation, so as to heat at least one of the two sides of the product 200.

According to an embodiment of the present disclosure, in Step S3, the two infrared radiators 20 are turned on to heat the two sides of the matte tin-plated product 200 simultaneously, thereby further improving the uniformity of the thickness of the tin coatings on both internal and external sides.

According to an embodiment of the present disclosure, Step S3 further includes: before turning on the infrared radiator 20 for preheating, presetting a heating temperature of each of the plurality of heating zones in the infrared radiator 20 to further improve the heating efficiency.

Further, the plurality of heating zones have heating temperatures that increase sequentially.

According to an embodiment of the present disclosure, taking the characteristics of continuous strips of micro terminals into consideration, the number of the heating zones may be three, namely, a first preheating zone A, a second heat preservation zone B, and a third heating zone C. The three zones are arranged in the same hearth, each zone can be equipped with the infrared radiant tubes 23, and the temperature of each infrared radiant tubes 23 can be set independently and can be precisely controlled. Moreover, after being heated and melted in the third heating zone C, the product 200 can be cooled as soon as possible. Therefore, the method for surface treatment of the matte tin-plated product in a micro continuous region has the following advantages. It can heat the matte tin-plated product in a micro region quickly, has high selectivity on the matte tin-plated regions to be treated, and has no impact on the surface-plated metal in other regions. It achieves precise and stable temperature control and saves energy as it maximizes the use of infrared radiation energy. It should be noted that, other numbers of heating zones can also be set according to specific situations.

According to an embodiment of the present disclosure, in order to maximize the photothermal efficiency to save energy, the treatment method for heating the matte tin-plated product in a micro continuous region into bright tin must satisfy the condition that, the preheating of the first preheating zone A, the heat preservation of the second heat preservation zone B, and the heat treatment of the third heating zone C are integrated, that is, the three zones are in the same hearth, and the set temperature of each zone is precisely controllable.

In some specific embodiments of the present disclosure, to ensure that the surface temperatures of the product set by the first preheating zone A, the second heat preservation zone B, and the third heating zone C in the hearth remain constant, the air temperature in each zone of the hearth needs to be lower than the surface temperature of the product in each zone, and the air temperature should be kept constant; the discharge of hot air and the intake of cold air in the hearth are automatically controlled based on the set air temperature in the hearth.

Optionally, the heating temperature of the first preheating zone A is 180° C.-190° C., and the second heat preservation zone B can keep the product 200 at approximately 200° C.

According to an embodiment of the present disclosure, the first preheating zone A, the second heat preservation zone B, and the third heating zone C are each provided with a plurality of infrared radiant tubes 23 that are distributed at intervals in the vertical direction, and the adjustable light-gathering range of each infrared radiant tube 23 is 1 mm-3 mm. The length direction of the surface to be heated of the product 200 is consistent with the direction of the movement path and a width direction thereof is perpendicular to the direction of the movement path. That is, when the movement path extends in the horizontal direction, the width direction of the product 200 is along the vertical direction. When the product to be treated is 2 mm-3 mm wide and the available light-gathering range of the infrared radiant tube 23 is: 2 mm≤light-gathering range≤3 mm, the infrared radiant tube 23 on the bottom layer in each of the three zones can be used to meet the requirements. When the infrared radiant tubes 23 are arranged on two sides of the product 200, a total of six infrared radiant tubes 23 are needed in the three zones. When the product to be treated is 2 mm-6 mm wide and the available light-gathering range of the infrared radiant tube 23 is: 2 mm≤light-gathering range≤6 mm, the infrared radiant tubes 23 on the first and second layers from the bottom in each of the three zones can be used to meet the requirements. When the infrared radiant tubes 23 are arranged on two sides of the product 200, a total of twelve infrared radiant tubes 23 are needed in the three zones. When the product to be treated is 2 mm-9 mm wide and the available light-gathering range of the infrared radiant tube 23 is: 2 mm≤light-gathering range≤9 mm, the infrared radiant tubes 23 on the first, second, and third layers from the bottom in each of the three zones can be used to meet the requirements. When the infrared radiant tubes 23 are arranged on two sides of the product 200, a total of eighteen infrared radiant tubes 23 are needed in the three zones. In other words, the method for surface treatment according to the embodiment of the present disclosure can determine the number of the infrared radiant tubes 23 to be used according to the product width, so that it can selectively convert the matte tin-plated product into bright tin with high efficiency and ensure that the gold-plated part in the micro conductive functional region will not be affected, and can maximize the use of infrared radiation energy while ensuring the quality of the electroplated product.

In some specific embodiments of the present disclosure, a proper distance between the continuous matte tin-plated product in a micro region and the corresponding infrared radiant tube 23 is in a range of: 20 mm≤distance≤80 mm. An acceptable distance between the continuous matte tin-plated product in a micro region and the infrared radiant tubes 23 on two sides of the product is in a range of: 10 mm≤distance≤110 mm. When the distance between the infrared radiant tube 23 and the product is less than 20 mm, the infrared radiant tube 23 gets too close to the product 200 and may be scratched by the product in the case of an accident in production. When the distance between the infrared radiant tube 23 and the product is greater than 80 mm, the infrared radiant tube 23 gets too far away from the product, so that the light efficiency of the infrared radiant tube 23 is reduced and the infrared radiation energy cannot be utilized to the maximum. Therefore, the distance between the product and the infrared radiant tube 23 on one side or on each of the two sides of the product is in a range of: 20 mm≤distance≤80 mm.

In some specific embodiments of the present disclosure, the first preheating zone A and the second heat preservation zone B are each provided with multiple layers of infrared radiant tubes 23 that are distributed at intervals in the vertical direction. For example, three layers of infrared radiant tubes 23 are used, and the infrared radiant tube 23 on each layer has a width of 3 mm in the vertical direction and a length of 300 mm along the length direction of the movement path. The infrared radiant tubes 23 can be distributed on two sides of the product. In other words, a total of six tubes on one side, that is, twelve tubes on both sides, can be arranged in the first preheating zone A and the second heat preservation zone B. The infrared radiant tubes 23 in the third heating zone C can be installed in the following three manners:

(1) The third heating zone C is provided with three layers of infrared radiant tubes 23 that are distributed at intervals in the vertical direction and can be installed on two sides of the product 200. The infrared radiant tube 23 on each layer extends in the horizontal direction, and has a width of 3 mm in the vertical direction and a length of 200 mm along the length direction of the movement path. When the infrared radiant tubes 23 are arranged on two sides of the product 200, a total of six infrared radiant tubes 23 are arranged on both sides of the product in the third heating zone C.

(2) The third heating zone C is provided with three rows of infrared radiant tubes 23 that are distributed at intervals along the length direction of the movement path. The infrared radiant tube 23 on each row extends in the vertical direction, and has a width of 3 mm and a length of 20 mm, wherein the width is a dimension along the length direction of the movement path and the length is a dimension in a vertical direction that is perpendicular to the direction of the movement path. When the infrared radiant tubes 23 are arranged on two sides of the product 200, a total of six infrared radiant tubes 23 can be arranged on both sides of the product 200 in the third heating zone C.

(3) In the third heating zone C, the infrared radiant tubes 23 are arranged on at least one side of the matte tin-plated product according to an oblique angle of the product, wherein the angle formed between the product and the horizontal direction is in a range of 0°<angle<180°. The infrared radiant tube 23 corresponding to the third heating zone C has a width of 3 mm and a length of 20 mm. When the infrared radiant tubes 23 are arranged on two sides of the product 200, a total of six infrared radiant tubes 23 can be arranged on both sides of the product in the third heating zone C.

In other words, according to the shape of the matte tin-plated region of the continuous terminal, a most suitable arrangement of the infrared radiant tubes 23 can be selected from the above manners for heat treatment. That is, the infrared radiator 20 with adjustable light-gathering capability is used for heating a continuous matte tin-plated product in a micro region that continuously runs at a certain speed. The direction and position of the infrared radiator 20 can be selectively adjusted for the region to be heated according to the shape of the matte tin-plated product, and the temperature of each selected zone is precisely set and controlled. When the region to be heated of the matte tin-plated product in a micro region is strip-shaped in an X direction, the infrared radiator 20 is arranged in the X direction to maximize the use of infrared radiation energy. When the region to be heated of the matte tin-plated product is in a Y direction, the infrared radiator 20 is arranged in the Y direction to maximize the use of infrared radiation energy. Similarly, when the angle formed between the region to be heated of the matte tin-plated product and the X direction is in a range of 0°<angle<180°, the infrared radiator 20 is also arranged at an angle satisfying 0°<angle<180° to maximize the use of infrared radiation energy.

According to an embodiment of the present disclosure, the method for surface treatment is applicable to micro continuous terminals and continuous strips with diversified structures.

When a micro continuous terminal or continuous strip runs along a moving track at a speed of 4 m/min, the three zones involved in the method for surface treatment can be selected for use in the following different situations according to the size of the matte tin-plated region of the product:

(1) When the width of the electroplated matte tin of the continuous terminal in a micro region is in a range of: width≤2 mm, only the second heat preservation zone B and the third heating zone C are used.

(2) When the width of the electroplated matte tin of the continuous terminal in a micro region is in a range of: 2 mm≤width≤9 mm, all the three zones are used.

(3) When the width of the electroplated matte tin of the continuous strip in a micro region is in a range of: 1 mm≤width≤9 mm, all the three zones must be used.

That is, the heating zones are selected according to different situations. Therefore, unnecessary energy consumption is avoided and energy can be saved and used effectively.

In other words, as for a matte tin-plated product of a continuous strip, the product is 9 mm wide and has electroplated matte tin of 4.5 mm in a micro conductive functional region and a matte tin-plated pin region for soldering of 2.5 mm, and a nickel-plated isolation region of at least 2.0 mm must be maintained between the conductive functional region and the pin region. When the product is to be heated, the heat treatment conditions of the infrared radiator need to be set separately since the two regions have different areas of electroplated matte tin. Meanwhile, it should be ensured that the heat treatment conditions of the infrared radiator in each region do not interfere with each other, and the requirements of precise setting of the conditions and precise control of the temperature can be met.

Moreover, a stamped surface, that is, a front side, of the continuous terminal product is smooth, and the cut surface has round corners; while a rear side of the product is relatively unsmooth, and the cut surface has regularly shaped corners. Therefore, even if the front and rear sides have the same structure, due to the differences in surface smoothness and corners, the temperature conditions for infrared heat treatment of the front and rear sides may be different. The temperature conditions must be precisely set to ensure uniform thickness of the tin coatings on the front and rear sides.

According to an embodiment of the present disclosure, when a micro continuous terminal or continuous strip runs at a speed exceeding 4 m/min, the three zones involved in the method for surface treatment must be used for heat treatment of any matte tin-plated product. Moreover, the set temperature of the third heating zone C must be properly adjusted to effectively convert the matte tin-plated product of the continuous terminal or strip into a bright tin product.

Therefore, in the method for surface treatment according to the embodiment of the present disclosure, an infrared radiator treatment device with adjustable light-gathering capability can be used for heating the matte tin-plated product of the micro continuous terminal that continuously runs at a certain speed, so as to convert the product into a bright tin product. Moreover, the method for surface treatment according to the embodiment of the present disclosure can selectively heat the matte tin-plated product in a micro region without affecting the performance of other electroplated regions. According to the position and direction of the matte tin-plated region of the continuous terminal, the matte tin-plated product of the continuous terminal at any position can be selectively heated by adjusting the installation position and direction of the infrared radiator 20, so that the infrared radiation energy can be used to the maximum, the energy is saved, and the electroplating production cost is reduced.

In some specific embodiments of the present disclosure, in Step S3, the matte tin-plated product 200 is controlled to move at a constant speed along the movement path, so that the uniformity of the thickness of the tin coating is improved.

According to an embodiment of the present disclosure, in Step S3, the matte tin-plated product 200 in each of the plurality of heating zones is heated to a predetermined temperature for a time period of less than 1 s. The maximum temperature may reach up to 1200° C., and the high temperature on certain parts will not affect the surface of any other region of the product.

The method for surface treatment according to the embodiment of the present disclosure will be described in detail below with reference to the specific embodiments.

Embodiment 1

(1) A Matte Tin-Plated Raw Material 1 to be Heated is Prepared.

The raw material 1 is a matte tin-plated product of a continuous terminal in a micro region, wherein the product is 8.7 mm wide and has a gold-plated part of 1.8 mm in a conductive functional region and a matte tin-plated part of 2.0 mm in a pin region for soldering of a circuit board; the overall nickel coating thickness of the terminal is 1.3 μm-2.1 μm. A nickel-plated isolation region of at least 2.0 mm must be maintained between the conductive functional region and the pin region. The electroplated raw material can be obtained in advance from other continuous electroplating production lines.

(2) Surface Treatment

Figure 2:
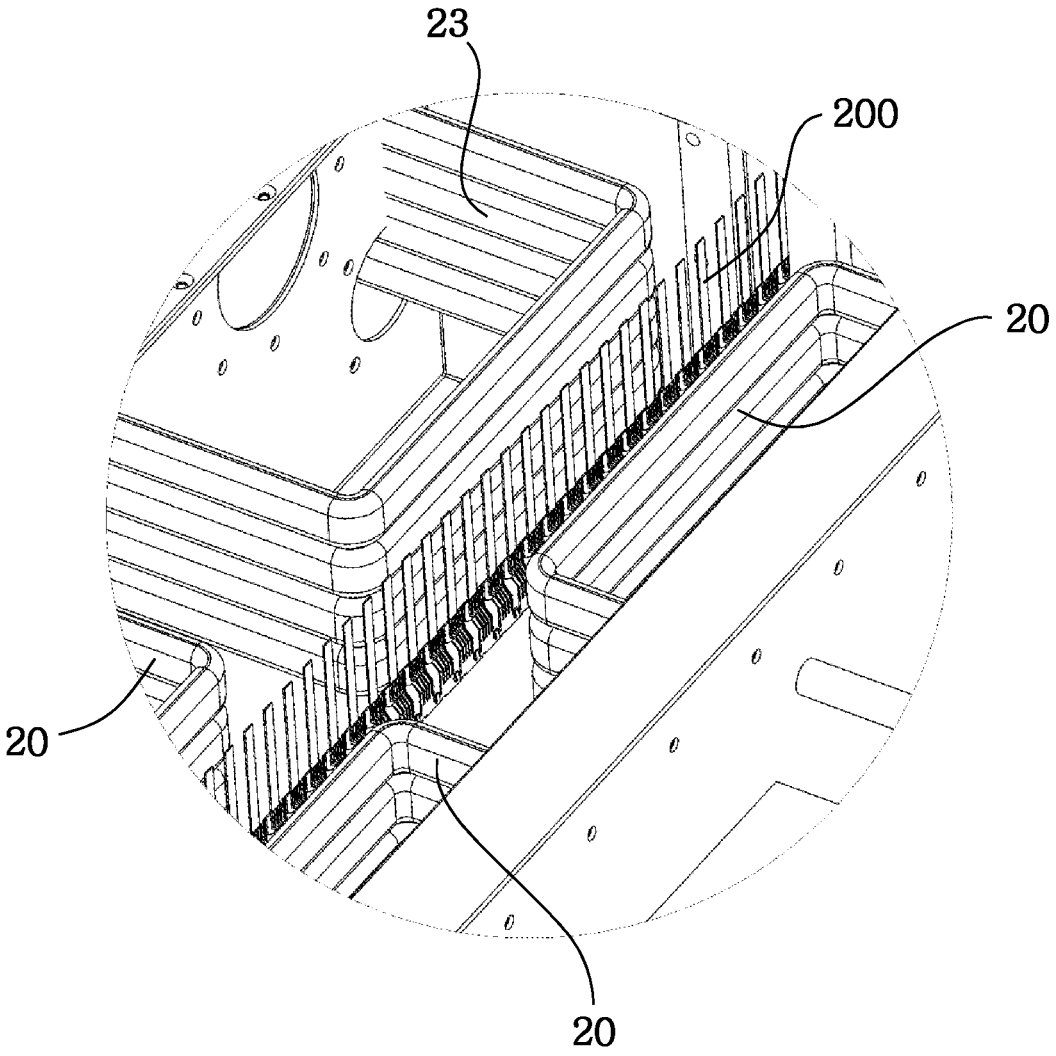
FIG. 2 is a schematic structural diagram of a surface treatment device applying the method for surface treatment according to the embodiment of the present disclosure.
Figure 3:
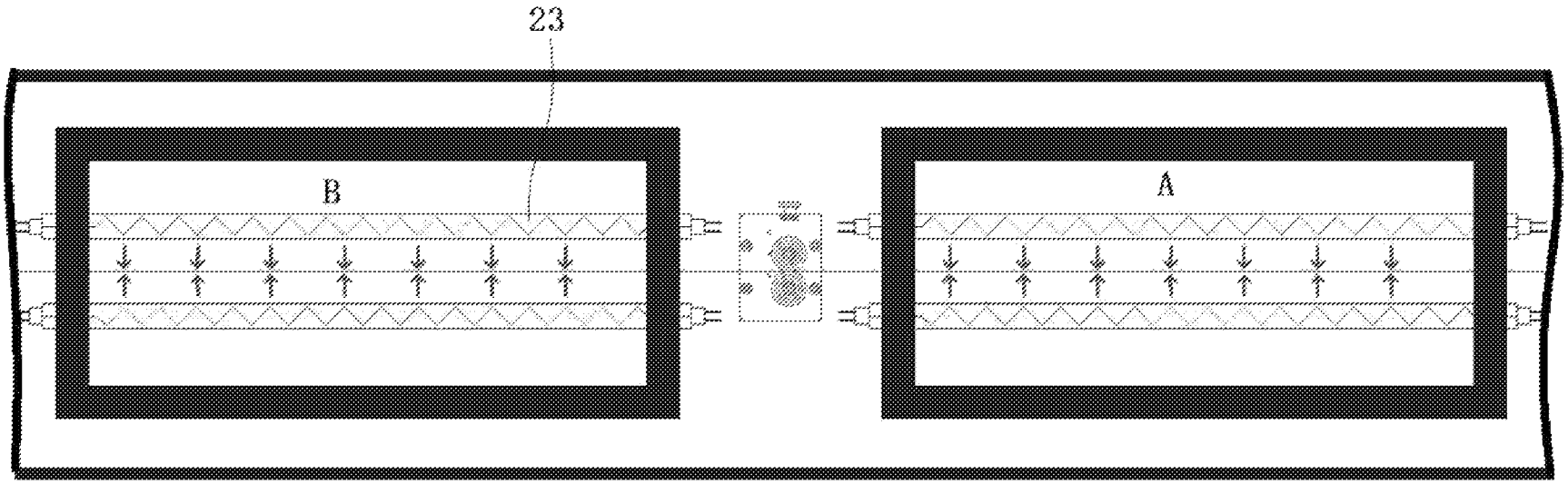
FIG. 3 is a schematic structural diagram illustrating horizontal arrangement of infrared radiant tubes in the method for surface treatment according to an embodiment of the present disclosure.
Figure 4:
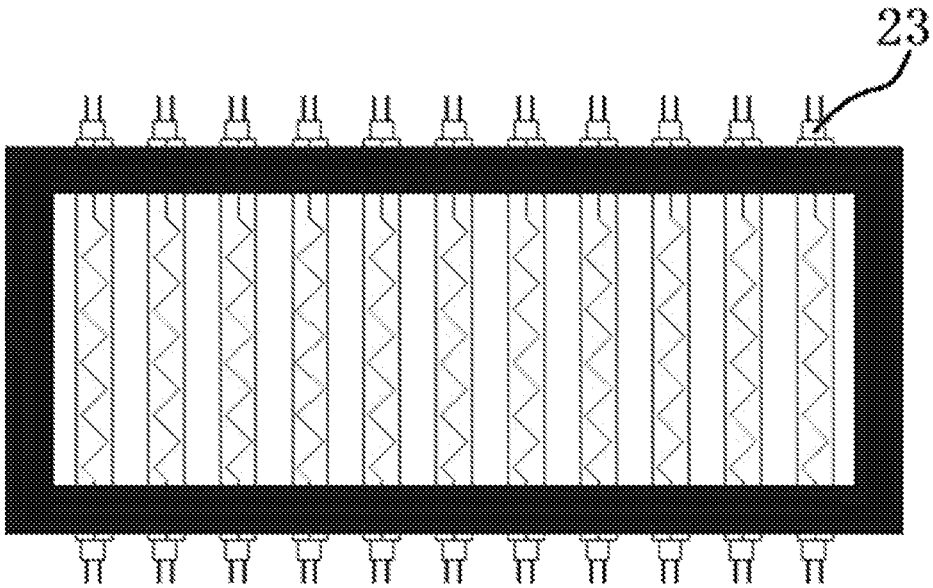
FIG. 4 is a schematic structural diagram illustrating vertical arrangement of infrared radiant tubes in the method for surface treatment according to another embodiment of the present disclosure.
Figure 5:
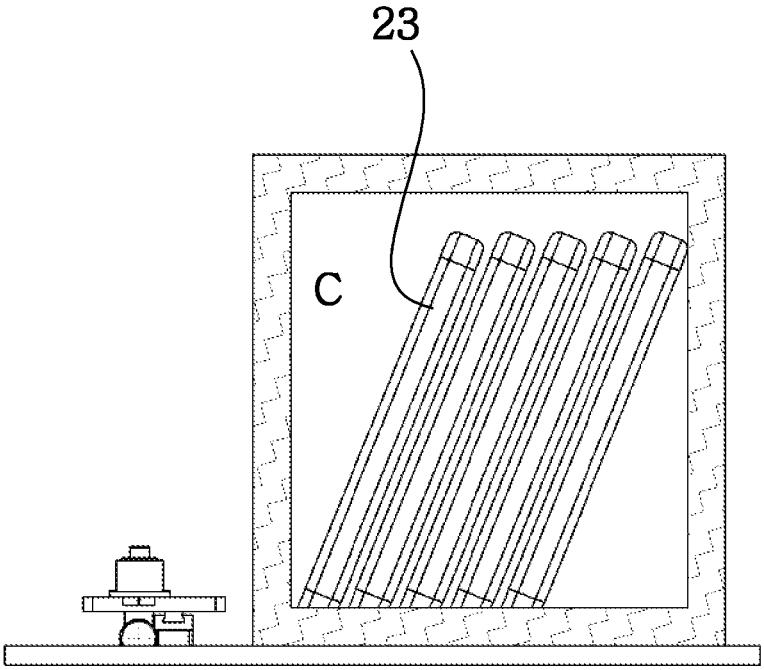
FIG. 5 is a schematic structural diagram illustrating oblique arrangement of infrared radiant tubes in the method for surface treatment according to still another embodiment of the present disclosure.
Figure 6:
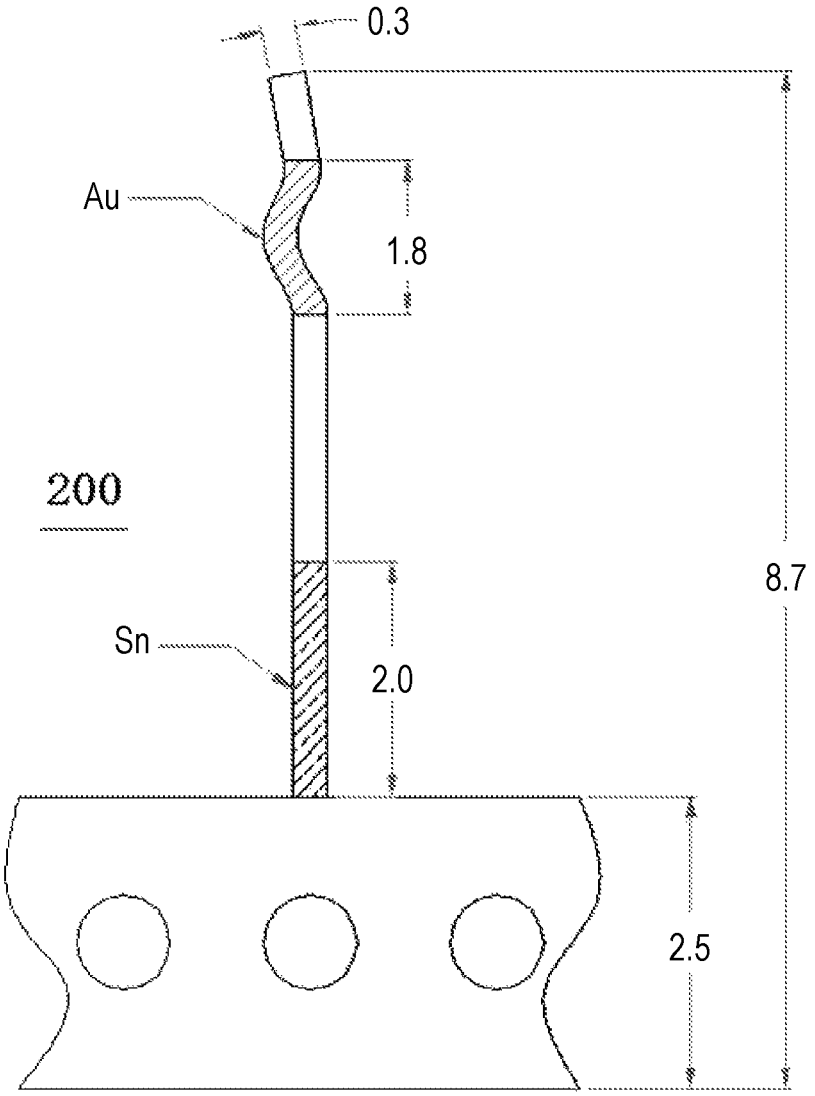
FIG. 6 is a schematic structural diagram of a matte tin-plated product according to Embodiment 1 of the present disclosure.

As shown in FIG. 1, FIG. 2, and FIG. 6, firstly, a material disc wound with the matte tin-plated raw material 1 is placed on a simple feed tray, the matte tin-plated material of a continuous terminal is drawn from the raw material disc and enters a hearth through a positioning fixture at an entrance of a surface treatment device, the matte tin-plated material passes through a positioning fixture and a product guide fixture in the hearth, and the product preparation work is completed through a positioning fixture and a driving guide wheel at an exit of the device. The positioning fixtures, the product guide fixture, and the driving guide wheel can cooperate to form a track.

Then, the short-wave infrared radiant tube 23 with adjustable light-gathering capability on a second layer from the bottom is used in each of the first preheating zone A and the second heat preservation zone B inside the hearth, wherein two tubes are arranged on each side and four on both sides. The infrared radiant tube 23 has a working width of 3 mm and a length of 300 mm, and is horizontally arranged in an X direction. The short-wave infrared radiant tube 23 with adjustable light-gathering capability on a second layer from the bottom is used in the third heating zone C, wherein one tube is arranged on each side and two on both sides. The infrared radiant tube 23 has a working width of 3 mm and a length of 200 mm, and is horizontally arranged in the X direction. The first preheating zone A, the second heat preservation zone B, and the third heating zone C can cooperate to heat the matte tin-plated region of 2.0 mm.

The temperature at four places on the second layer from the bottom and on two sides of the product in the first preheating zone A and the second heat preservation zone B is monitored by using four infrared radiation temperature controllers. The temperature at two places on the second layer from the bottom and on two sides of the product in the third heating zone C is monitored by using two infrared radiation temperature controllers.

The running speed of the electroplated product is set to 4 m/min, and the distance between the infrared radiant tube 23 and the product to be treated is set to 20 mm. The following conditions should be satisfied in order to convert the matte tin-plated product into bright tin. The temperature is 180° C. at two places on the second layer from the bottom and on both sides of the product in the first preheating zone A, the temperature is 200° C. at two places on the second layer from the bottom and on both sides of the product in the second heat preservation zone B, and the temperature is 245° C. at two places on the second layer from the bottom and on both sides of the product in the third heating zone C.

A bright tin product is obtained after treatment in the above conditions, a sample is taken for coating thickness measurement, and the following test is performed on the sample:

The appearance is checked to ensure that the surface of the tin-plated region is smooth and bright and no discoloration occurs in the gold-plated part of 1.8 mm. Then, a tin-coating thickness test is performed, wherein a coating thickness tester is used to obtain measurement data at an interval of 0.2 mm within the tin-plated part of 2.0 mm.

Comparative Example 1: The bright tin for comparison is obtained in advance from other continuous electroplating production lines, and is formed by heating with high-frequency induction.

Embodiment 2

(1) A Matte Tin-Plated Raw Material 2 to be Heated is Prepared.

The raw material 2 is a matte tin-plated product of a continuous strip in a micro region, wherein the product is 9.0 mm wide and has a matte tin-plated part of 4.5 mm in a conductive functional region and a matte tin-plated part of 2.5 mm in a pin region for soldering of a circuit board; the overall nickel coating thickness of the terminal is 1.3 μm-2.1 μm. A nickel-plated isolation region of at least 2.0 mm must be maintained between the conductive functional region and the pin region. The electroplated raw material can be obtained in advance from other continuous electroplating production lines.

(2) Surface Treatment

Figure 7:
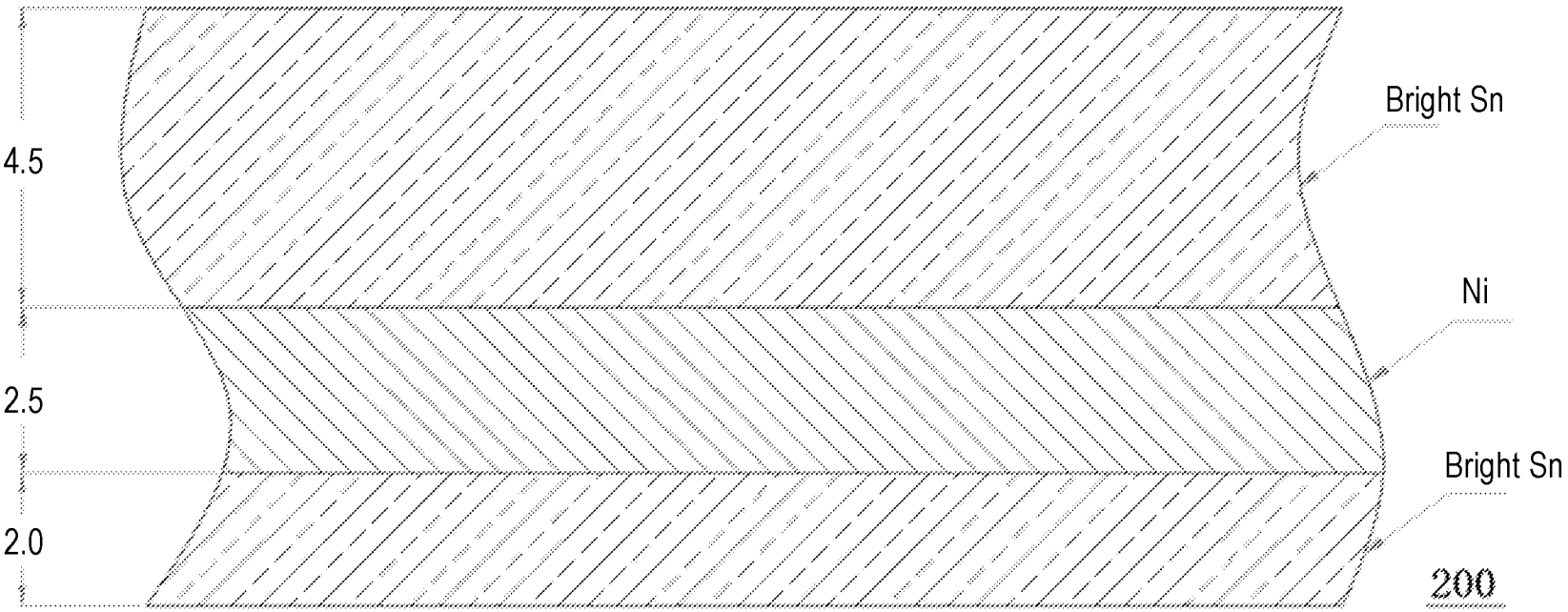
FIG. 7 is a schematic structural diagram of a matte tin-plated product according to Embodiment 2 of the present disclosure.

As shown in FIG. 1, FIG. 2, and FIG. 7, firstly, a material disc wound with the matte tin-plated raw material 2 is placed on a simple feed tray, the matte tin-plated material of a continuous terminal is drawn from the raw material disc and enters a hearth through a positioning fixture at an entrance of a surface treatment device, and the product preparation work is completed through a positioning fixture and a driving guide wheel at an exit of the device. The positioning fixtures and the driving guide wheel can cooperate to form a track.

Then, the short-wave infrared radiant tubes 23 with adjustable light-gathering capability on a second layer and a third layer from the bottom are used in each of the first preheating zone A and the second heat preservation zone B inside the hearth, wherein four tubes are arranged on each side and eight on both sides. The infrared radiant tubes 23 have a working width of 2×3 mm and a length of 300 mm, and are horizontally arranged in an X direction. The short-wave infrared radiant tubes 23 with adjustable light-gathering capability on a second layer and a third layer from the bottom are used in the third heating zone C, wherein two tubes are arranged on each side and four on both sides. The infrared radiant tubes 23 have a working width of 2×3 mm and a length of 200 mm, and are horizontally arranged in the X direction. The first preheating zone A, the second heat preservation zone B, and the third heating zone C can cooperate to heat the matte tin-plated region of 4.5 mm.

The short-wave infrared radiant tube 23 with adjustable light-gathering capability on a first layer from the bottom is used in each of the first preheating zone A and the second heat preservation zone B inside the hearth, wherein two tubes are arranged on each side and four on both sides. The infrared radiant tube 23 has a working width of 3 mm and a length of 300 mm, and is horizontally arranged in an X direction. The short-wave infrared radiant tube 23 with adjustable light-gathering capability on a first layer from the bottom is used in the third heating zone C, wherein one tube is arranged on each side and two on both sides. The infrared radiant tube 23 has a working width of 3 mm and a length of 200 mm, and is horizontally arranged in the X direction. The first preheating zone A, the second heat preservation zone B, and the third heating zone C can cooperate to treat the matte tin-plated region of 2.0 mm.

The temperature at eight places on the second layer and the third layer from the bottom and on two sides of the product in the first preheating zone A and the second heat preservation zone B is monitored by using eight infrared radiation temperature controllers. The temperature at four places on the second layer and the third layer from the bottom and on two sides of the product in the third heating zone C is monitored by using four infrared radiation temperature controllers. The plurality of infrared radiation temperature controllers can cooperate with each other to monitor the temperature of the matte tin-plated region of 4.5 mm.

The temperature at four places on the first layer from the bottom and on two sides of the product in the first preheating zone A and the second heat preservation zone B is monitored by using four infrared radiation temperature controllers. The temperature at two places on the first layer from the bottom and on two sides of the product in the third heating zone C is monitored by using two infrared radiation temperature controllers. The plurality of infrared radiation temperature controllers can cooperate with each other to monitor the temperature of the matte tin-plated region of 2.0 mm.

The running speed of the matte tin-plated product is set to 4 m/min, and the distance between the infrared radiant tube 23 and the product to be treated is set to 20 mm.

The following conditions should be satisfied in order to convert the electroplated matte tin of 4.5 mm into bright tin. The temperature is 190° C. at four places on the second layer and the third layer from the bottom and on both sides of the product in the first preheating zone A, the temperature is 205° C. at four places on the second layer and the third layer from the bottom and on both sides of the product in the second heat preservation zone B, and the temperature is 250° C. at four places on the second layer and the third layer from the bottom and on both sides of the product in the third heating zone C.

The following conditions should be satisfied in order to convert the electroplated matte tin of 2.5 mm into bright tin. The temperature is 180° C. at two places on the first layer from the bottom and on both sides of the product in the first preheating zone A, the temperature is 195° C. at two places on the first layer from the bottom and on both sides of the product in the second heat preservation zone B, and the temperature is 240° C. at two places on the first layer from the bottom and on both sides of the product in the third heating zone C.

A bright tin product is obtained after treatment in the above conditions, a sample is taken for coating thickness measurement, and the following test is performed on the sample:

The appearance is checked to ensure that the surface of the tin-plated region is smooth and bright. Then, a tin-coating thickness test is performed, wherein a coating thickness tester is used to obtain measurement data at an interval of 0.2 mm within the matte tin-plated part of 4.5 mm in the conductive functional region and obtain measurement data at an interval of 0.2 mm within the matte tin-plated part of 2.5 mm in the pin region for soldering of a circuit board.

Comparative Example 2: The bright tin for comparison is obtained in advance from other continuous electroplating production lines, and is formed by heating with superheated steam.

Embodiment 3

(1) A Matte Tin-Plated Raw Material 3 to be Heated is Prepared.

The raw material 3 is a matte tin-plated product of a continuous terminal in a micro region, wherein the product is 9.7 mm wide and has a matte tin-plated part of 4.5 mm in a conductive functional region and a matte tin-plated part of 2.0 mm in a pin region for soldering of a circuit board. The matte tin in the pin region does not need to be heated into bright tin. The overall nickel coating thickness of the terminal is 1.3 μm-2.1 μm. A nickel-plated isolation region of at least 2.0 mm must be maintained between the conductive functional region and the pin region. The electroplated raw material can be obtained in advance from other continuous electroplating production lines.

(2) Surface Treatment

Figure 8:
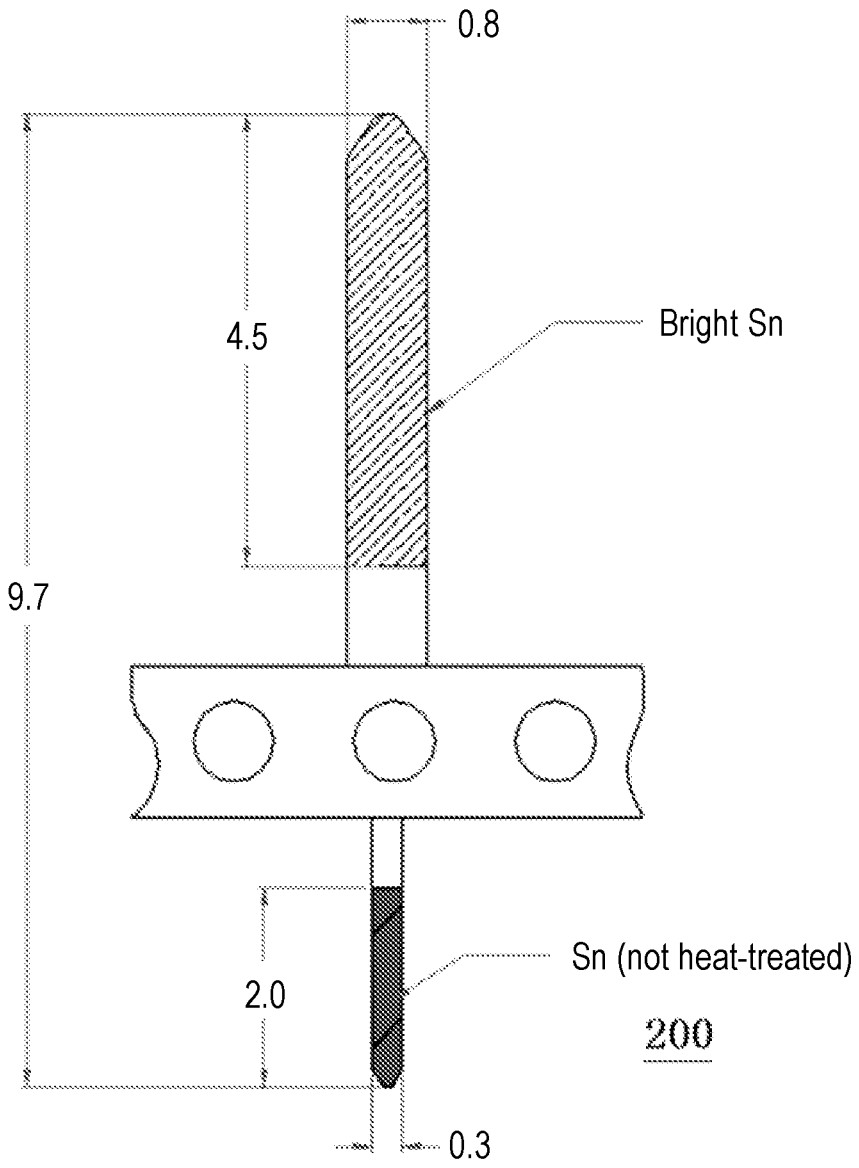
FIG. 8 is a schematic structural diagram of a matte tin-plated product according to Embodiment 3 of the present disclosure.

As shown in FIG. 1, FIG. 2, and FIG. 8, firstly, a material disc wound with the matte tin-plated raw material 3 is placed on a simple feed tray, the matte tin-plated material of a continuous terminal is drawn from the raw material disc and enters a hearth through a positioning fixture at an entrance of a surface treatment device, the matte tin-plated material passes through a positioning fixture and a product guide fixture in the hearth, and the product preparation work is completed through a positioning fixture and a driving guide wheel at an exit of the device. The positioning fixtures, the product guide fixture, and the driving guide wheel can cooperate to form a track.

Then, the short-wave infrared radiant tubes 23 with adjustable light-gathering capability on a second layer and a third layer from the bottom are used in each of the first preheating zone A and the second heat preservation zone B inside the hearth, wherein four tubes are arranged on each side and eight on both sides. The infrared radiant tubes 23 have a working width of 2×3 mm and a length of 300 mm, and are horizontally arranged in an X direction. The short-wave infrared radiant tubes 23 with adjustable light-gathering capability on a second layer and a third layer from the bottom are used in the third heating zone C, wherein two tubes are arranged on each side and four on both sides. The infrared radiant tubes 23 have a working width of 2×3 mm and a length of 200 mm, and are horizontally arranged in the X direction. The first preheating zone A, the second heat preservation zone B, and the third heating zone C can cooperate to heat the upper-layer matte tin-plated region of 4.5 mm.

The first preheating zone A and the second heat preservation zone B are equipped with the short-wave infrared radiant tubes 23. The temperature at eight places on the second layer and the third layer from the bottom and on two sides of the product in the first preheating zone A and the second heat preservation zone B is monitored by using eight infrared radiation temperature controllers. The temperature at four places on the second layer and the third layer from the bottom and on two sides of the product in the third heating zone C is monitored by using four infrared radiation temperature controllers. The plurality of infrared radiation temperature controllers can cooperate with each other to monitor the temperature of the matte tin-plated region of 4.5 mm. The short-wave infrared radiant tubes 23 with adjustable light-gathering capability and the infrared radiation temperature controllers on a first layer from the bottom in the third heating zone C are turned off.

The running speed of the matte tin-plated product in the micro region is set to 4 m/min, and the distance between the infrared radiant tube 23 and the product to be treated is set to 20 mm.

The following conditions should be satisfied in order to convert the electroplated matte tin of 4.5 mm into bright tin. The temperature is 190° C. at four places on the second layer and the third layer from the bottom and on both sides of the product in the first preheating zone A, the temperature is 200° C. at four places on the second layer and the third layer from the bottom and on both sides of the product in the second heat preservation zone B, and the temperature is 255° C. at four places on the second layer and the third layer from the bottom and on both sides of the product in the third heating zone C.

A bright tin product is obtained after treatment in the above conditions, a sample is taken for coating thickness measurement, and the following test is performed on the sample:

The appearance is checked to ensure that the surface of the tin-plated region is smooth and bright. Then, a tin-coating thickness test is performed, wherein a coating thickness tester is used to obtain measurement data at an interval of 0.2 mm within the tin-plated region of 6.0 mm.

Comparative Example 3: The bright tin for comparison is obtained in advance from other continuous electroplating production lines, and is formed by heating with a hot-air blower.

Embodiment 4

(1) A Matte Tin-Plated Raw Material 4 to be Heated is Prepared.

The raw material 4 is a matte tin-plated product of a continuous terminal in a micro region, wherein the product is 8.0 mm wide, and the overall nickel coating thickness of the continuous terminal is 1.3 μm-2.1 μm. Besides a region of 2.0 mm for positioning holes of the continuous terminal, the matte tin-plated region is of 6.0 mm. The electroplated raw material can be obtained in advance from other continuous electroplating production lines.

(2) Surface Treatment

Figure 9:
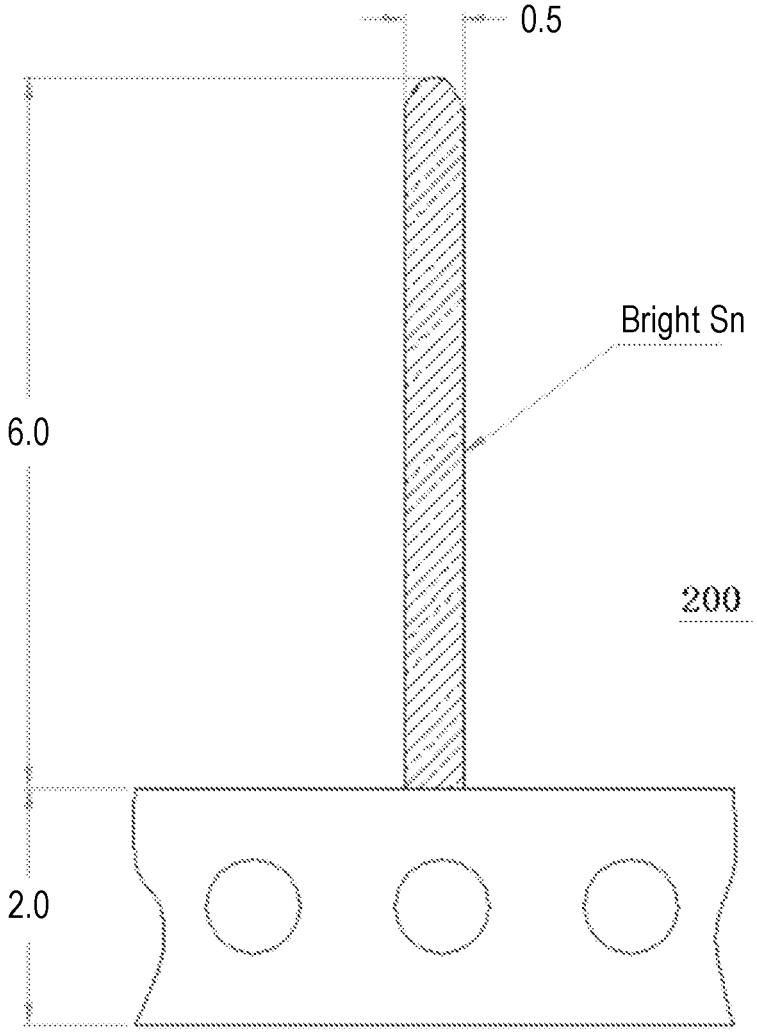
FIG. 9 is a schematic structural diagram of a matte tin-plated product according to Embodiment 4 of the present disclosure.

As shown in FIG. 1, FIG. 2, and FIG. 9, firstly, a material disc wound with the matte tin-plated raw material 4 is placed on a simple feed tray, the matte tin-plated material of a continuous terminal is drawn from the raw material disc and enters a hearth through a positioning fixture at an entrance of a surface treatment device, the matte tin-plated material passes through a positioning fixture and a product guide fixture in the hearth, and the product preparation work is completed through a positioning fixture and a driving guide wheel at an exit of the device. The positioning fixtures, the product guide fixture, and the driving guide wheel can cooperate to form a track.

Then, the short-wave infrared radiant tubes 23 with adjustable light-gathering capability on a second layer and a third layer from the bottom are used in each of the first preheating zone A and the second heat preservation zone B inside the hearth, wherein four tubes are arranged on each side and eight on both sides. The infrared radiant tubes 23 have a working width of 2×3 mm and a length of 300 mm, and are horizontally arranged in an X direction. The short-wave infrared radiant tubes 23 with adjustable light-gathering capability on a second layer and a third layer from the bottom are used in the third heating zone C, wherein two tubes are arranged on each side and four on both sides. The infrared radiant tubes 23 have a working width of 2×3 mm and a length of 200 mm, and are horizontally arranged in the X direction. In other words, infrared radiators are respectively arranged on two sides of the product to be treated in the hearth.

The temperature at eight places on the second layer and the third layer from the bottom and on two sides of the product in the first preheating zone A and the second heat preservation zone B is monitored by using eight infrared radiation temperature controllers. The temperature at four places on the second layer and the third layer from the bottom and on two sides of the product in the third heating zone C is monitored by using four infrared radiation temperature controllers. The plurality of infrared radiation temperature controllers can cooperate with each other to monitor the temperature of the matte tin-plated region of 6.0 mm.

The temperature in the first preheating zone A and the second heat preservation zone B is monitored by using four infrared radiation temperature controllers. The temperature on the upper and middle layers in the third heating zone C is monitored by using four infrared radiation temperature controllers.

The running speed of the electroplated product is set to 4 m/min, and the distance between the infrared radiant tube 23 and the product to be treated is set to 20 mm.

The following conditions should be satisfied in order to convert the electroplated matte tin of 6.0 mm into bright tin. The temperature is 180° C. at four places on the second layer and the third layer from the bottom and on both sides of the product in the first preheating zone A, the temperature is 200° C. at four places on the second layer and the third layer from the bottom and on both sides of the product in the second heat preservation zone B, and the temperature is 245° C. at four places on the second layer and the third layer from the bottom and on both sides of the product in the third heating zone C. A bright tin product is obtained after treatment in the above conditions, a sample is taken for coating thickness measurement, and the following test is performed on the sample: The appearance is checked to ensure that the surface of the tin-plated region is smooth and bright. Then, a tin-coating thickness test is performed, wherein a coating thickness tester is used to obtain measurement data at an interval of 0.2 mm within the matte tin-plated region of 6.0 mm.

Comparative Example 4: The bright tin for comparison is obtained in advance from other continuous electroplating production lines, and is formed by heating with a hot-air blower.

Embodiment 5

(1) A Matte Tin-Plated Raw Material 5 to be Heated is Prepared.

The raw material 5 is a matte tin-plated product of a continuous terminal in a micro region, wherein the product is 9.5 mm wide, and the overall nickel coating thickness of the continuous terminal is 1.3 μm-2.1 μm. A matte tin-plated region of the continuous terminal is of 9.5 mm. The electroplated raw material can be obtained in advance from other continuous electroplating production lines.

(2) Surface Treatment

Figure 10:
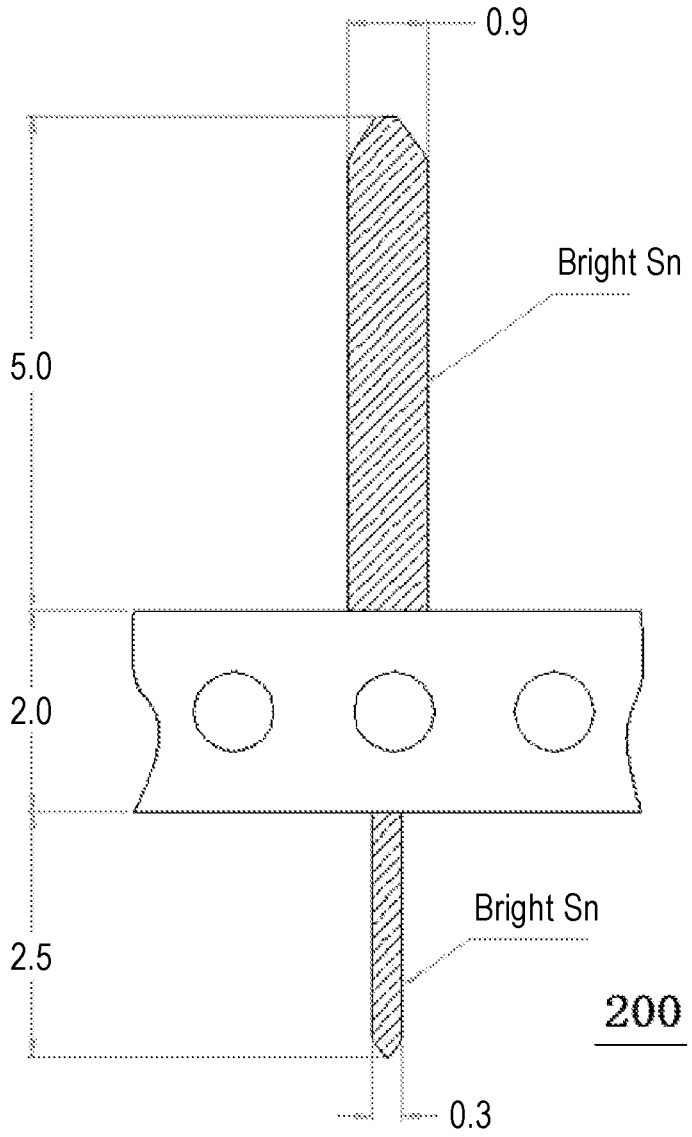
FIG. 10 is a schematic structural diagram of a matte tin-plated product according to Embodiment 5 of the present disclosure.

As shown in FIG. 1, FIG. 2, and FIG. 10, firstly, a material disc wound with the matte tin-plated raw material 5 is placed on a simple feed tray, the matte tin-plated material of a continuous terminal is drawn from the raw material disc and enters a hearth through a positioning fixture at an entrance of a surface treatment device, the matte tin-plated material passes through a positioning fixture and a product guide fixture in the hearth, and the product preparation work is completed through a positioning fixture and a driving guide wheel at an exit of the device. The positioning fixtures, the product guide fixture, and the driving guide wheel can cooperate to form a track.

Then, the short-wave infrared radiant tubes 23 with adjustable light-gathering capability on a second layer and a third layer from the bottom are used in each of the first preheating zone A and the second heat preservation zone B inside the hearth, wherein four tubes are arranged on each side and eight on both sides. The infrared radiant tubes 23 have a working width of 2×3 mm and a length of 300 mm, and are horizontally arranged in an X direction. The short-wave infrared radiant tubes 23 with adjustable light-gathering capability on a second layer and a third layer from the bottom are used in the third heating zone C, wherein two tubes are arranged on each side and four on both sides. The infrared radiant tubes 23 have a working width of 2×3 mm and a length of 200 mm, and are horizontally arranged in the X direction. The plurality of infrared radiant tubes 23 can cooperate with each other to heat the matte tin-plated region of 5.0 mm.

The short-wave infrared radiant tube 23 with adjustable light-gathering capability on a first layer from the bottom is used in each of the first preheating zone A and the second heat preservation zone B inside the hearth, wherein two tubes are arranged on each side and four on both sides. The infrared radiant tube 23 has a working width of 3 mm and a length of 300 mm, and is horizontally arranged in an X direction. The short-wave infrared radiant tube 23 with adjustable light-gathering capability on a first layer from the bottom is used in the third heating zone C, wherein one tube is arranged on each side and two on both sides. The infrared radiant tube 23 has a working width of 3 mm and a length of 200 mm, and is horizontally arranged in the X direction. The plurality of infrared radiant tubes 23 can cooperate with each other to treat the matte tin-plated region of 2.0 mm.

The temperature at eight places on the second layer and the third layer from the bottom and on two sides of the product in the first preheating zone A and the second heat preservation zone B is monitored by using eight infrared radiation temperature controllers. The temperature at four places on the second layer and the third layer from the bottom and on two sides of the product in the third heating zone C is monitored by using four infrared radiation temperature controllers. The plurality of infrared radiation temperature controllers can cooperate with each other to monitor the temperature of the matte tin-plated region of 5.0 mm.

The temperature at four places on the first layer from the bottom and on two sides of the product in the first preheating zone A and the second heat preservation zone B is monitored by using four infrared radiation temperature controllers. The temperature at two places on the first layer from the bottom and on two sides of the product in the third heating zone C is monitored by using two infrared radiation temperature controllers. The plurality of infrared radiation temperature controllers can cooperate with each other to monitor the temperature of the matte tin-plated region of 2.5 mm. The temperature on the upper and middle layers in the third heating zone C is monitored by using four infrared radiation temperature controllers. The temperature on the lower layer in the third heating zone C is monitored by using two infrared radiation temperature controllers.

The running speed of the matte tin-plated product is set to 4 m/min, and the distance between the infrared radiant tube 23 and the product to be treated is set to 20 mm.

The following conditions should be satisfied in order to convert the electroplated matte tin of 5.0 mm into bright tin. The temperature is 190° C. at four places on the second layer and the third layer from the bottom and on both sides of the product in the first preheating zone A, the temperature is 200° C. at four places on the second layer and the third layer from the bottom and on both sides of the product in the second heat preservation zone B, and the temperature is 255° C. at four places on the second layer and the third layer from the bottom and on both sides of the product in the third heating zone C.

The following conditions should be satisfied in order to convert the electroplated matte tin of 2.5 mm into bright tin. The temperature is 180° C. at two places on the first layer from the bottom and on both sides of the product in the first preheating zone A, the temperature is 190° C. at two places on the first layer from the bottom and on both sides of the product in the second heat preservation zone B, and the temperature is 245° C. at two places on the first layer from the bottom and on both sides of the product in the third heating zone C.

A bright tin product is obtained after treatment in the above conditions, a sample is taken for coating thickness measurement, and the following test is performed on the sample:

The appearance is checked to ensure that the surface of the tin-plated region is smooth and bright. Then, a tin-coating thickness test is performed, wherein a coating thickness tester is used to obtain measurement data at an interval of 0.2 mm within the matte tin-plated part of 5.0 mm in a conductive functional region and obtain measurement data at an interval of 0.2 mm within the matte tin-plated part of 2.5 mm in a pin region for soldering of a circuit board.

Comparative Example 5: The bright tin for comparison is obtained in advance from other continuous electroplating production lines, and is formed by heating with high-frequency induction.

Embodiment 6

(1) A Matte Tin-Plated Raw Material 6 to be Heated is Prepared.

The raw material 6 is a matte tin-plated product of a continuous terminal in a micro region, wherein the product is 9.5 mm wide, and the overall nickel coating thickness of the continuous terminal is 1.3 μm-2.1 μm; the product has a matte tin-plated part of 3.5 mm in a conductive functional region and a matte tin-plated part of 2.0 mm in a pin region for soldering of a circuit board; and a nickel-plated isolation region of at least 2.0 mm must be maintained between the conductive functional region and the pin region. The electroplated raw material can be obtained in advance from other continuous electroplating production lines.

The matte tin-plated region of the continuous terminal is of 9.5 mm. The electroplated raw material can be obtained in advance from other continuous electroplating production lines.

(2) Surface Treatment

Figure 11:
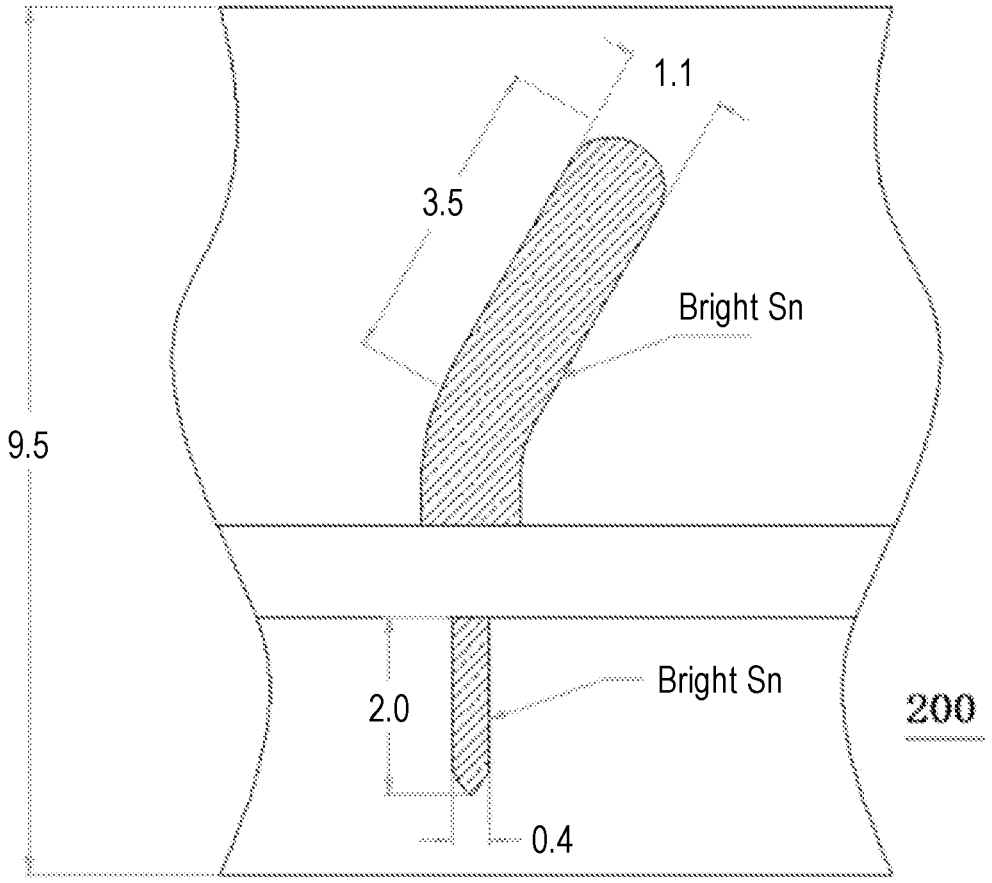
FIG. 11 is a schematic structural diagram of a matte tin-plated product according to Embodiment 6 of the present disclosure.
Figure 12:
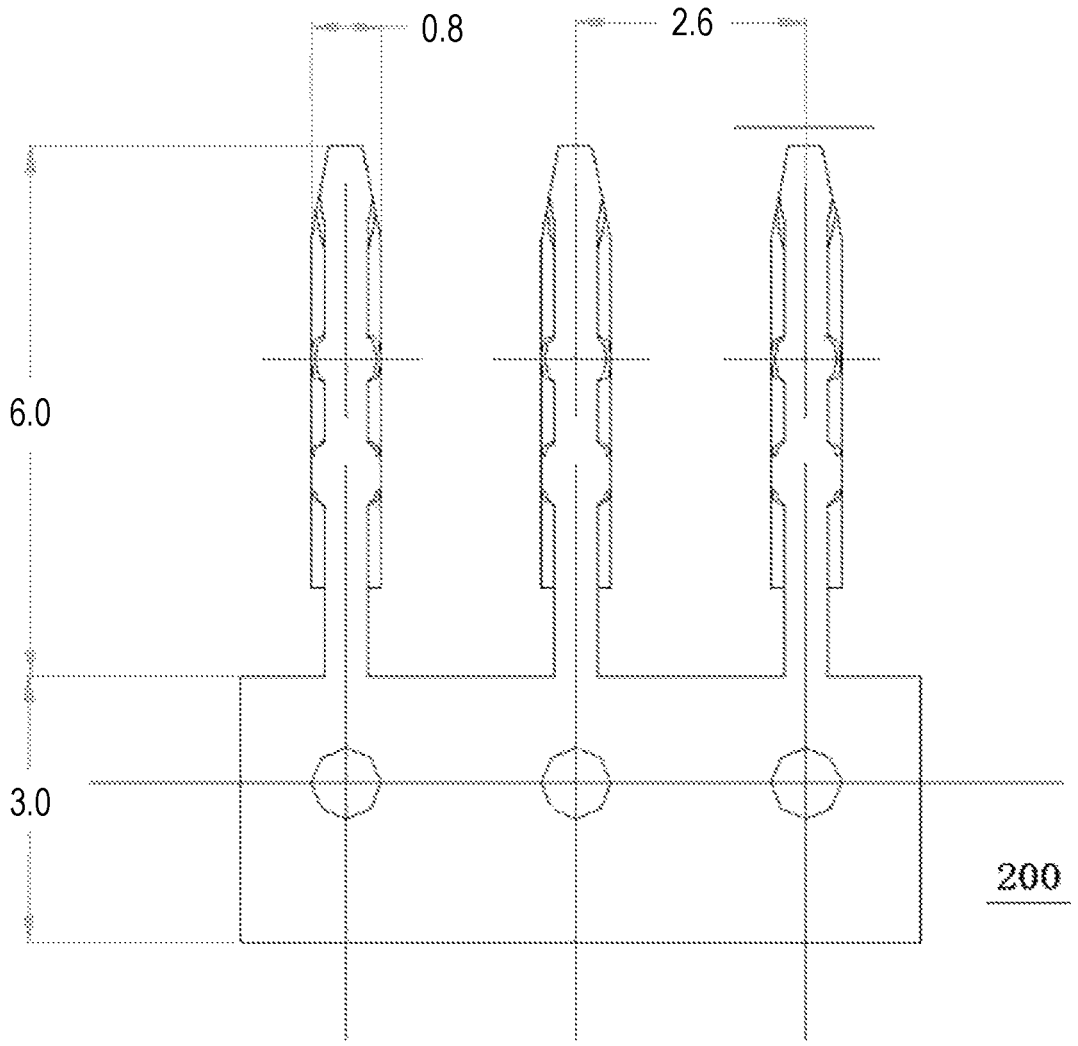
FIG. 12 is a schematic structural diagram of a matte tin-plated product according to Embodiment 7 of the present disclosure.

As shown in FIG. 1, FIG. 2, and FIG. 11, firstly, a material disc wound with the matte tin-plated raw material 6 is placed on a simple feed tray, the matte tin-plated material of a continuous terminal is drawn from the raw material disc and enters a hearth through a positioning fixture at an entrance of a surface treatment device, the matte tin-plated material passes through a positioning fixture and a product guide fixture in the hearth, and the product preparation work is completed through a positioning fixture and a driving guide wheel at an exit of the device. The positioning fixtures, the product guide fixture, and the driving guide wheel can cooperate to form a track.

Then, the short-wave infrared radiant tubes 23 with adjustable light-gathering capability on a second layer and a third layer from the bottom are used in each of the first preheating zone A and the second heat preservation zone B inside the hearth, wherein four tubes are arranged on each side and eight on both sides. The infrared radiant tubes 23 have a working width of 2×3 mm and a length of 300 mm, and are horizontally arranged in an X direction. The short-wave infrared radiant tubes 23 with adjustable light-gathering capability that are obliquely arranged on an upper layer are used in the third heating zone C, wherein five tubes are arranged on each side and ten on both sides. The infrared radiant tubes 23 have a working width of 5×3 mm and a length of 50 mm, and the oblique angle is formed between the matte tin-plated region of 3.5 mm and the X direction, wherein 0°<angle<180°. The first preheating zone A, the second heat preservation zone B, and the third heating zone C can cooperate to heat the matte tin-plated region of 3.5 mm.

The short-wave infrared radiant tube 23 with adjustable light-gathering capability on a first layer from the bottom is used in each of the first preheating zone A and the second heat preservation zone B inside the hearth, wherein two tubes are arranged on each side and four on both sides. The infrared radiant tube 23 has a working width of 3 mm and a length of 300 mm, and is horizontally arranged in an X direction. The short-wave infrared radiant tube 23 with adjustable light-gathering capability on a lower layer is used in the third heating zone C, wherein one tube is arranged on each side and two on both sides. The infrared radiant tube 23 has a working width of 3 mm and a length of 200 mm. The first preheating zone A, the second heat preservation zone B, and the third heating zone C can cooperate to treat the matte tin-plated region of 2.0 mm. The plurality of infrared radiation temperature controllers can be used to monitor the temperature of the matte tin-plated regions of 3.5 mm and 2.0 mm separately.

The running speed of the matte tin-plated product is set to 4 m/min, and the distance between the infrared radiant tube 23 and the product to be treated is set to 20 mm.

The following conditions should be satisfied in order to convert the electroplated matte tin of 3.5 mm into bright tin. The temperature is 190° C. at four places on the second layer and the third layer from the bottom and on both sides of the product in the first preheating zone A, the temperature is 200° C. at four places on the second layer and the third layer from the bottom and on both sides of the product in the second heat preservation zone B, and the temperature is 255° C. at four places on the second layer and the third layer from the bottom and on both sides of the product in the third heating zone C.

The following conditions should be satisfied in order to convert the electroplated matte tin of 2.0 mm into bright tin. The temperature is 180° C. at two places on the first layer from the bottom and on both sides of the product in the first preheating zone A, the temperature is 190° C. at two places on the first layer from the bottom and on both sides of the product in the second heat preservation zone B, and the temperature is 245° C. at two places on the first layer from the bottom and on both sides of the product in the third heating zone C. The second layer and the third layer in the first preheating zone A are at a temperature of 190° C., the second layer and the third layer in the second heat preservation zone B are at a temperature of 200° C., the second layer and the third layer in the third heating zone C are at a temperature of 255° C., and the first layer in the third heating zone C is at a temperature of 245° C.

A bright tin product is obtained after treatment in the above conditions, a sample is taken for coating thickness measurement, and the following test is performed on the sample:

The appearance is checked to ensure that the surface of the tin-plated region is smooth and bright. Then, a tin-coating thickness test is performed, wherein a coating thickness tester is used to obtain measurement data at an interval of 0.2 mm within the matte tin-plated part of 3.5 mm in the conductive functional region and obtain measurement data at an interval of 0.2 mm within the matte tin-plated part of 2.0 mm in the pin region for soldering of a circuit board.

Comparative Example 6: The bright tin for comparison is obtained in advance from other continuous electroplating production lines, and is formed by heating with a hot-air blower.

Embodiment 7

(1) A Matte Tin-Plated Raw Material 7 to be Heated is Prepared.

The raw material 7 is a matte tin-plated product of a continuous strip in a micro region, wherein the product is 9.0 mm wide, the overall matte tin-plated region is of 6.0 mm, and the overall nickel coating thickness of the terminal is 1.3 μm-2.1 μm. The electroplated raw material can be obtained in advance from other continuous electroplating production lines.

(2) Surface Treatment

Figure 13:
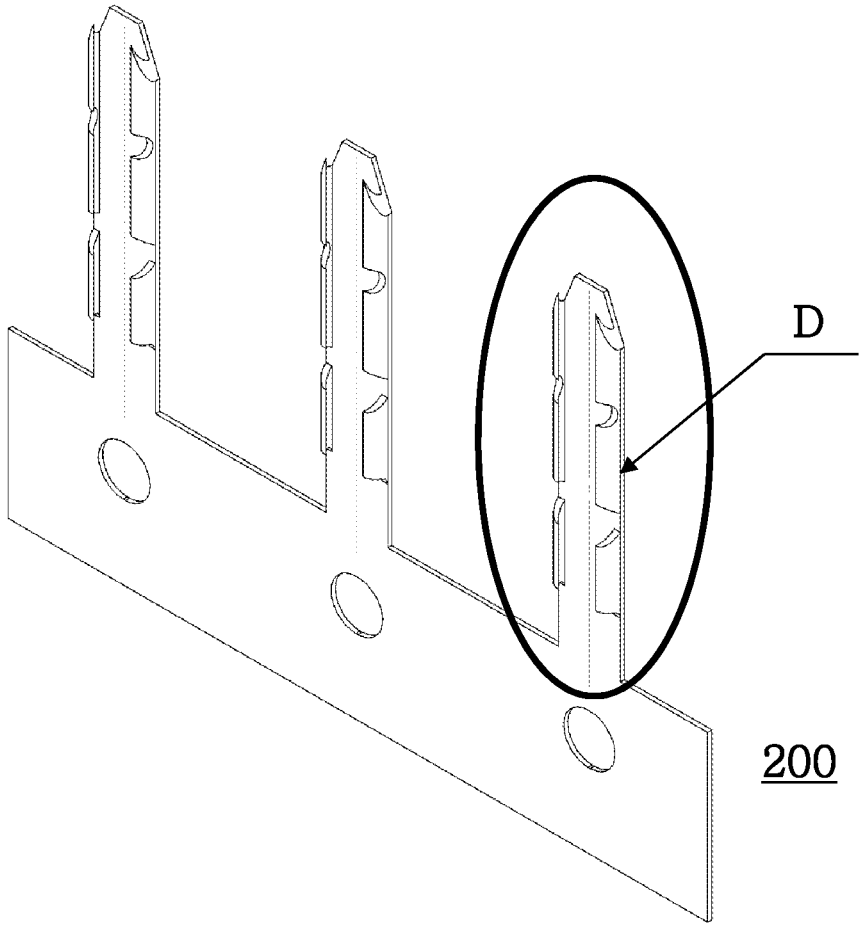
FIG. 13 is a schematic three-dimensional structural diagram of the matte tin-plated product according to Embodiment 7 of the present disclosure.
Figure 14:
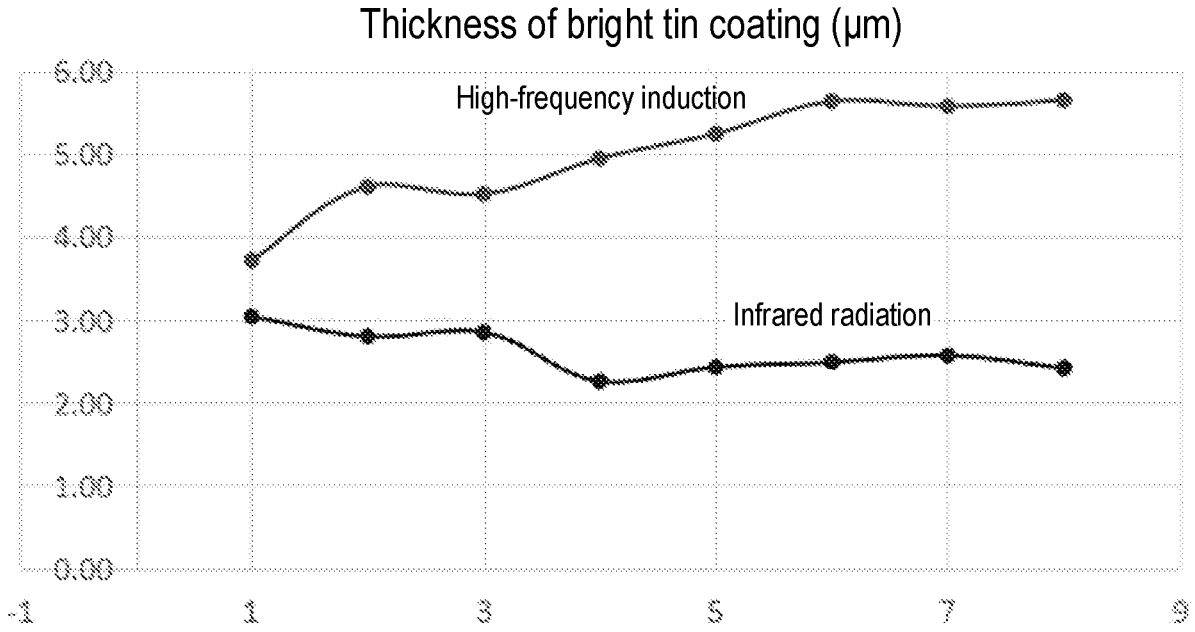
FIG. 14 is a comparison diagram of coating thickness according to Embodiment 1 of the present disclosure and Comparative Example 1.
Figure 15:
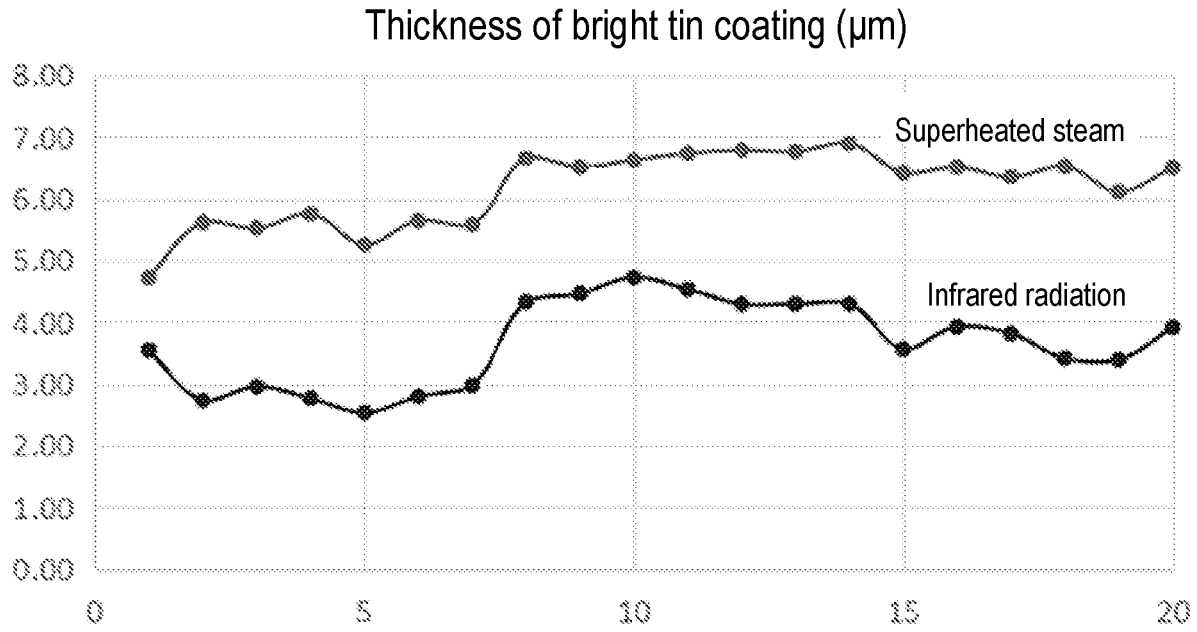
FIG. 15 is a comparison diagram of coating thickness (in a conductive functional region) according to Embodiment 2 of the present disclosure and Comparative Example 2.
Figure 16:
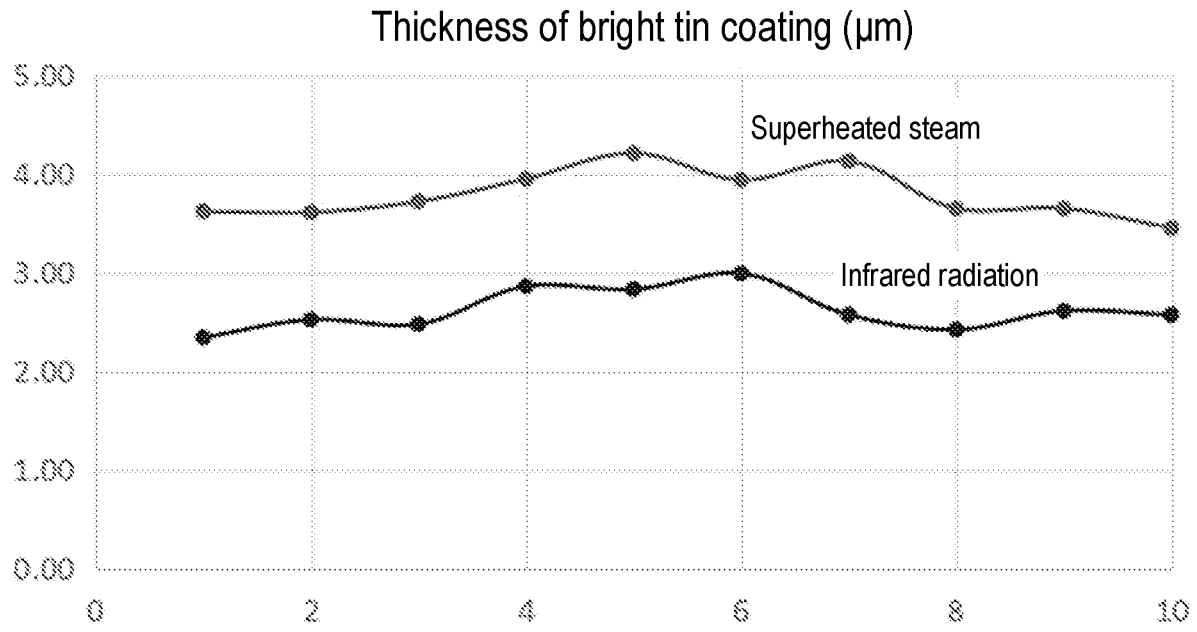
FIG. 16 is a comparison diagram of coating thickness (in a soldering region) according to Embodiment 2 of the present disclosure and Comparative Example 2.
Figure 17:
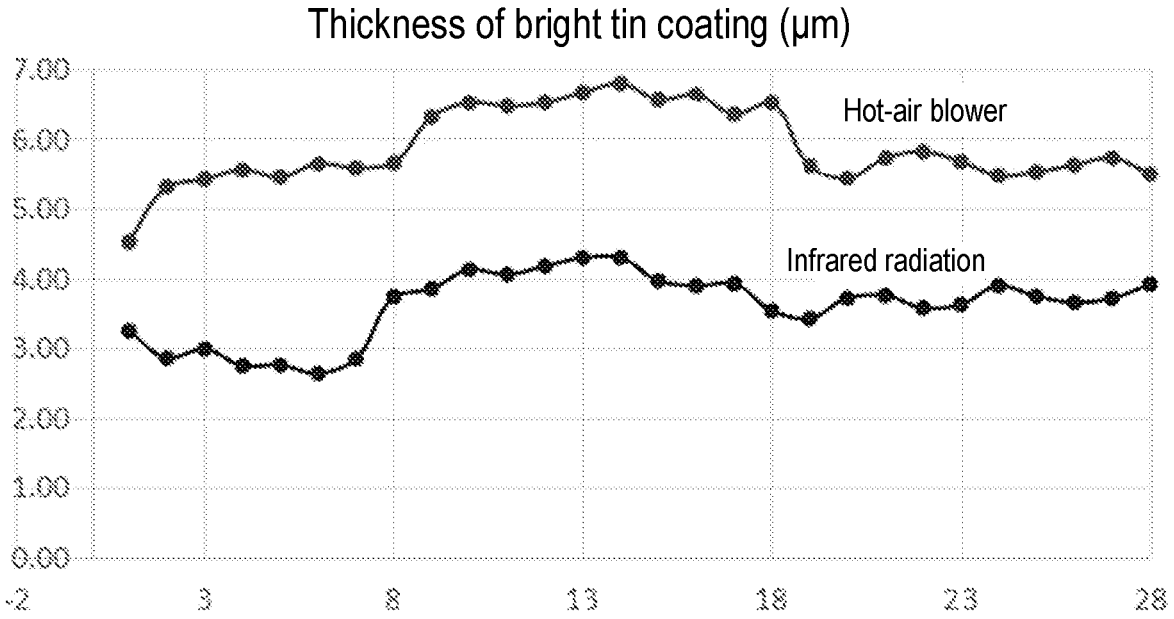
FIG. 17 is a comparison diagram of coating thickness according to Embodiment 3 of the present disclosure and Comparative Example 3.
Figure 18:
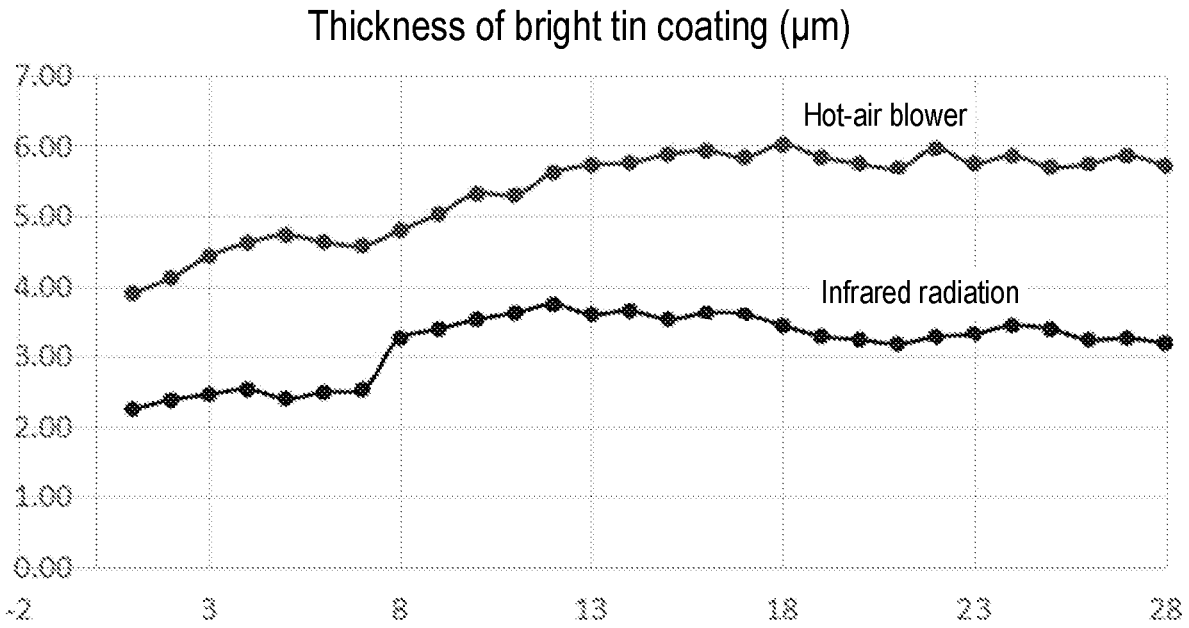
FIG. 18 is a comparison diagram of coating thickness according to Embodiment 4 of the present disclosure and Comparative Example 4.
Figure 19:
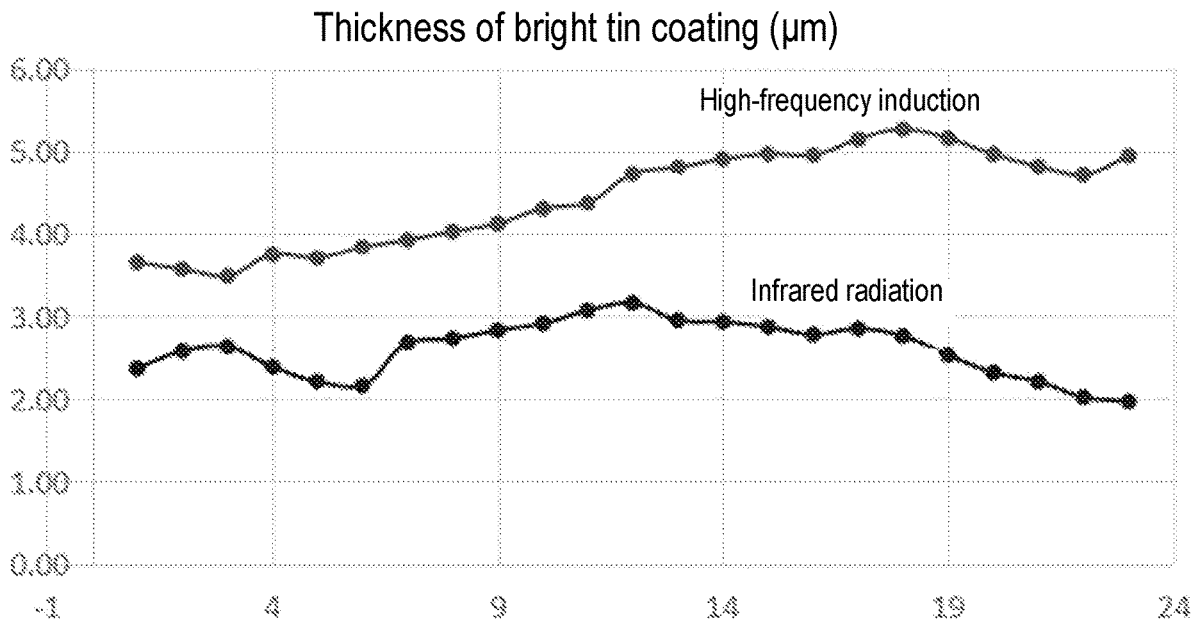
FIG. 19 is a comparison diagram of coating thickness (in a conductive functional region) according to Embodiment 5 of the present disclosure and Comparative Example 5.
Figure 20:
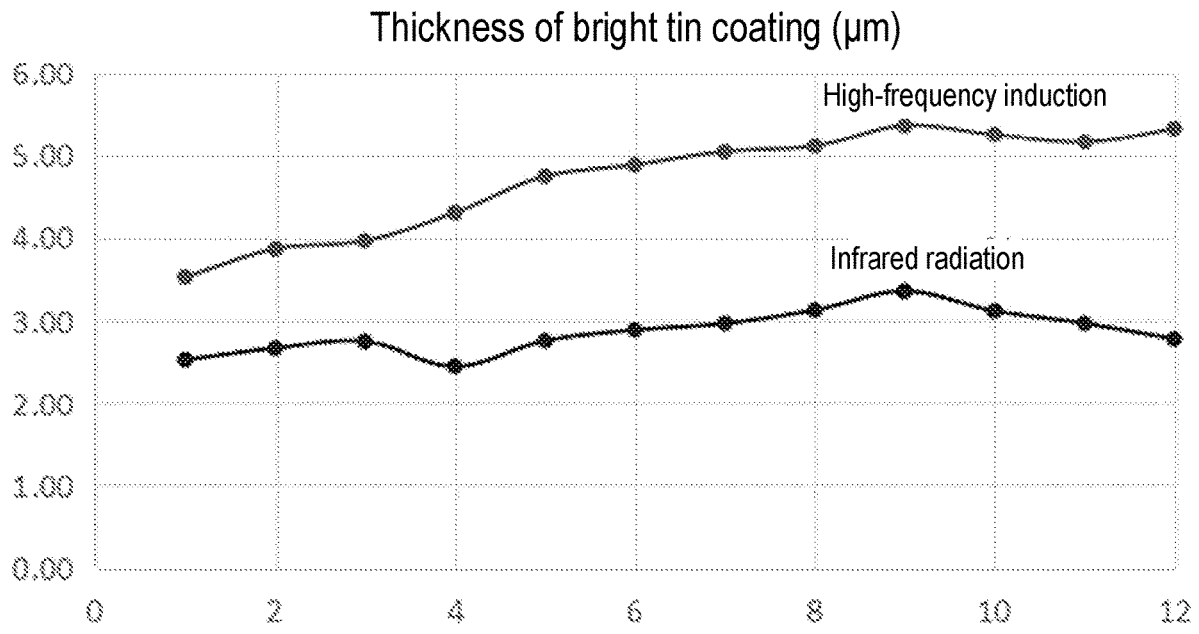
FIG. 20 is a comparison diagram of coating thickness (in a soldering region) according to Embodiment 5 of the present disclosure and Comparative Example 5.
Figure 21:
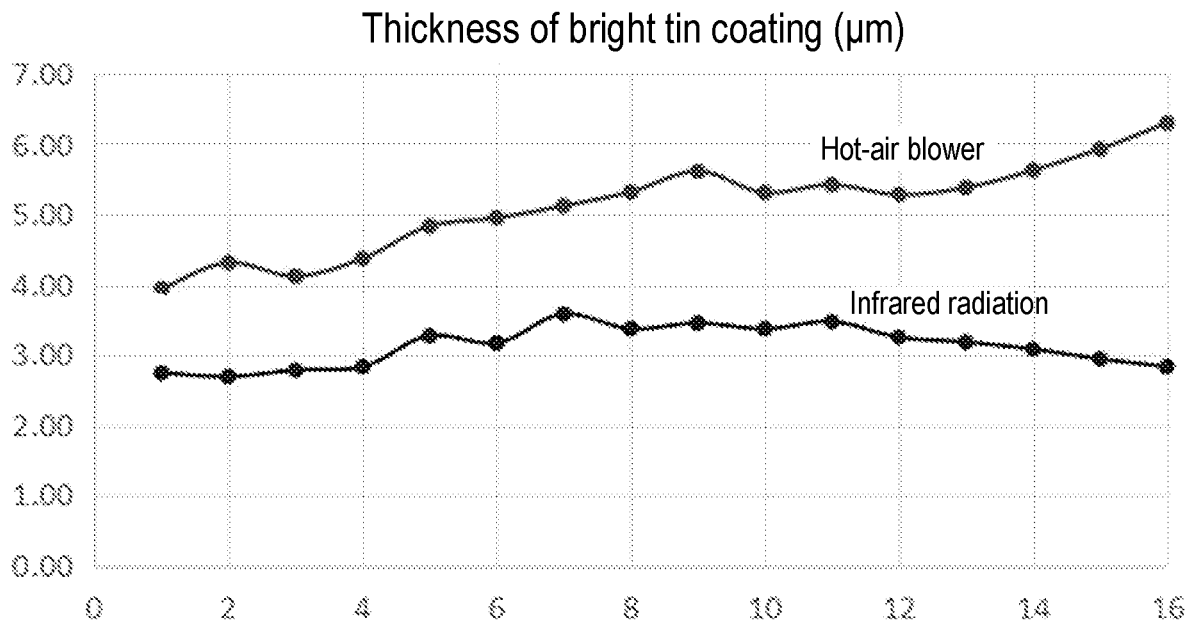
FIG. 21 is a comparison diagram of coating thickness (in a conductive functional region) according to Embodiment 6 of the present disclosure and Comparative Example 6.
Figure 22:
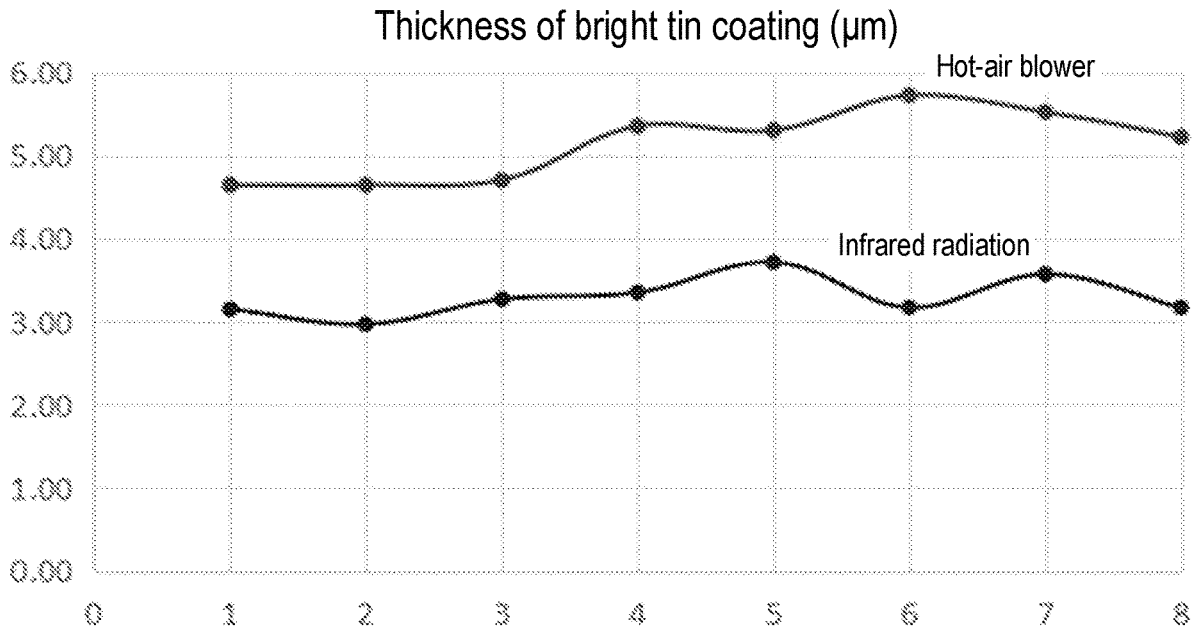
FIG. 22 is a comparison diagram of coating thickness (in a soldering region) according to Embodiment 6 of the present disclosure and Comparative Example 6.
Figure 23:
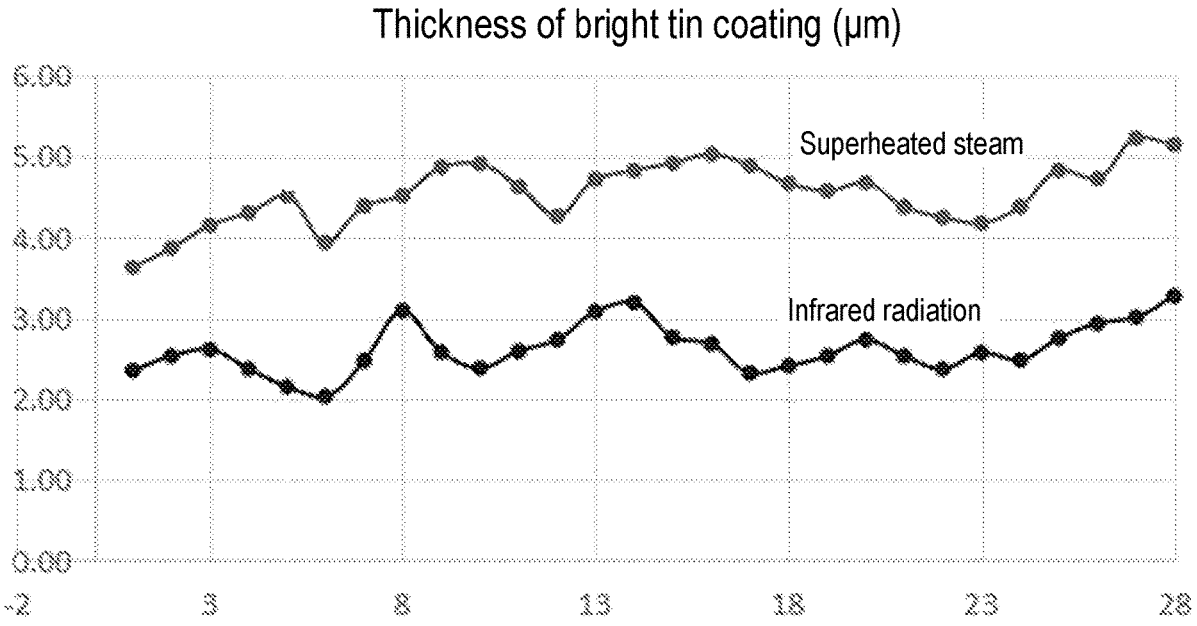
FIG. 23 is a comparison diagram of coating thickness (on a front side of a terminal) according to Embodiment 7 of the present disclosure and Comparative Example 7.
Figure 24:
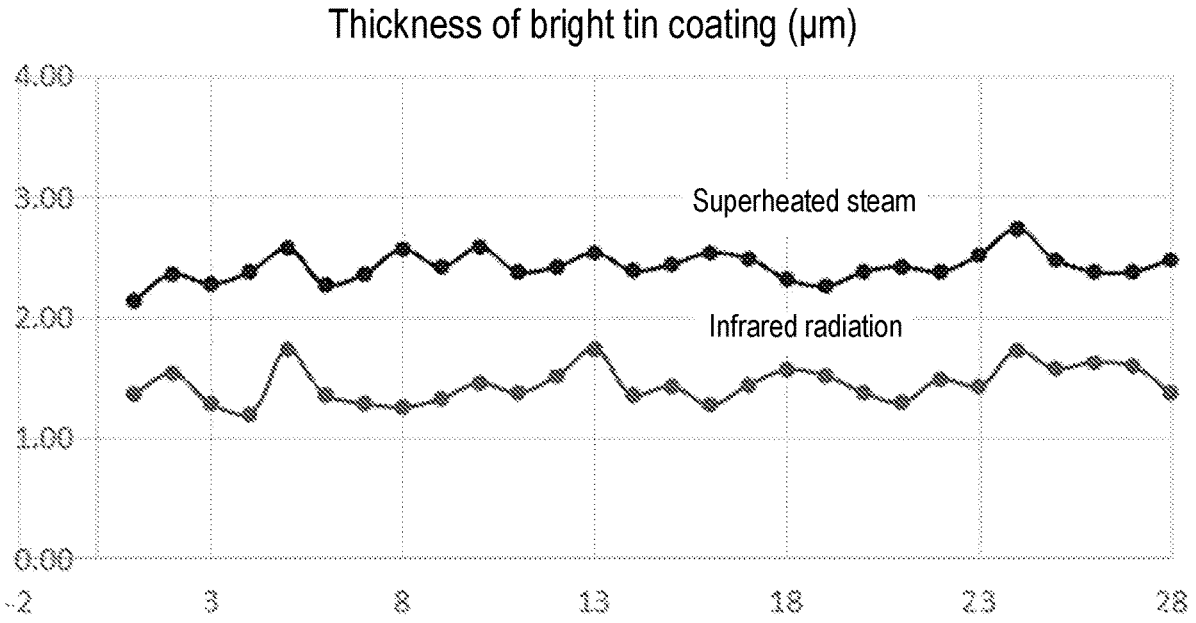
FIG. 24 is a comparison diagram of coating thickness (on a rear side of the terminal) according to Embodiment 7 of the present disclosure and Comparative Example 7.

As shown in FIG. 1, FIG. 2, FIG. 12, and FIG. 13, D in FIG. 13 indicates that bright tin is formed on every surface in the region. Firstly, a material disc wound with the matte tin-plated raw material 7 is placed on a simple feed tray, the matte tin-plated material of a continuous terminal is drawn from the raw material disc and enters a hearth through a positioning fixture at an entrance of a surface treatment device, and the product preparation work is completed through a positioning fixture and a driving guide wheel at an exit of the device. The positioning fixtures and the driving guide wheel can cooperate to form a track.

Then, the short-wave infrared radiant tubes 23 with adjustable light-gathering capability on a second layer and a third layer from the bottom are used in each of the first preheating zone A and the second heat preservation zone B inside the hearth, wherein four tubes are arranged on each side and eight on both sides. The infrared radiant tubes 23 have a working width of 2×3 mm and a length of 300 mm, and are horizontally arranged in an X direction. The short-wave infrared radiant tubes 23 with adjustable light-gathering capability on four rows, namely, a second row to a fifth row from a most front row, are used in the third heating zone C, wherein five tubes are arranged on each side and ten on both sides. The infrared radiant tubes 23 have a working width of 5×3 mm and a length of 100 mm, and are arranged in a direction perpendicular to the horizontal direction (that is, they are vertically arranged). In other words, the short-wave infrared radiant tubes 23 with adjustable light-gathering capability are arranged on two sides of the product to be treated inside the hearth, and the plurality of infrared radiation temperature controllers 1 can cooperate with each other to monitor the temperature of the matte tin-plated region of 6.0 mm.

The running speed of the electroplated product is set to 4 m/min, and the distance between the infrared radiant tube 23 and the product to be treated is set to 20 mm.

The following conditions should be satisfied in order to convert the electroplated matte tin of 6.0 mm into bright tin. The temperature is 190° C. at four places on the second layer and the third layer from the bottom and on both sides of the product in the first preheating zone A, the temperature is 205° C. at four places on the second layer and the third layer from the bottom and on both sides of the product in the second heat preservation zone B, and the temperature is 250° C. at ten places on the five rows and on both sides of the product in the third heating zone C.

A bright tin product is obtained after treatment in the above conditions, a sample is taken for coating thickness measurement, and the following test is performed on the sample:

The appearance is checked to ensure that the surface of the tin-plated region is smooth and bright. Then, a tin-coating thickness test is performed, wherein a coating thickness tester is used to obtain measurement data at an interval of 0.2 mm within a region of 3.5 mm on a front side of the terminal and obtain measurement data at an interval of 0.2 mm on a rear side of the terminal.

Comparative Example 7: The bright tin for comparison is obtained in advance from other continuous electroplating production lines, and is formed by heating with superheated steam.

In a word, the method for surface treatment of the matte tin-plated product 200 according to the embodiment of the present disclosure is easy to operate, can realize not only heating by infrared radiation, but also simultaneous internal and external heating according to requirements, and can perform partial and selective treatment to achieve specific purposes.

In this specification, referring to descriptions about the terms "one embodiment", "some embodiments", "exemplary embodiments", "examples", "specific examples", "some examples" and the like, the specific features, structures, materials, or characteristics illustrated by the embodiments or examples are incorporated in at least one embodiment or example of the present disclosure. In this specification, the schematic statements of the above terms do not necessarily mean the same embodiments or examples. Moreover, the illustrated specific features, structures, materials, or characteristics can be properly combined in any one or more embodiments or examples.

Although the embodiments of the present disclosure have been shown and described, persons of ordinary skill in the art can understand that various changes, modifications, replacements, and variations can be made to these embodiments without departing from the principle and purpose of the present disclosure. The scope of the present disclosure is defined by the appended claims and their equivalents.

What is claimed is:

1. A method for surface treatment of a matte tin-plated product, which is configured for heating the matte tin electroplated already on a surface of the matte tin-plated product into a bright tin, the method for surface treatment comprises heating the surface of the matte tin-plated product with infrared rays, wherein the infrared rays are emitted by an infrared radiator and the infrared radiator comprises a plurality of heating zones arranged at intervals, and the method for surface treatment comprises:

Step S1: setting a movement path of the matte tin-plated product according to a position of the infrared radiator, the movement path comprising a waiting position and a heating position;

Step S2: placing the matte tin-plated product at the waiting position, and allowing a side of the matte tin-plated product to be heated to face the infrared radiator; and Step S3: turning on the infrared radiator for preheating, and controlling the matte tin-plated product to sequentially pass through the plurality of heating zones along the movement path to undergo partial heating and then be transported out, wherein a width of the matte tin-plated product is 2-10 mm, the infrared radiator comprises a plurality of infrared radiant tubes, and a light-gathering range of each of the plurality of infrared radiant tubes is 1-3 mm, wherein the Step S3 further comprises: before turning on the infrared radiator for preheating, determining a number of the plurality of infrared radiant tubes to be used according to the width of the matte tin-plated product, wherein a distance between the matte tin-plated product and the corresponding infrared radiant tube is 20-80 mm.

2. The method according to claim 1, wherein two infrared radiators are provided, the two infrared radiators are arranged facing each other and each of the two infrared radiators is provided with the plurality of heating zones arranged at intervals along a length direction of the movement path, and in the Step S1, the movement path is located between the two infrared radiators, and the matte tin is electroplated on each of two sides of the matte tin-plated product.

3. The method according to claim 2, wherein the two infrared radiators are symmetrically arranged on two sides of the movement path.

4. The method according to claim 2, wherein in the Step S3, the two infrared radiators are turned on to heat the two sides of the matte tin-plated product simultaneously.

5. The method according to claim 1, wherein the Step S3 further comprises: before turning on the infrared radiator for preheating, presetting a heating temperature of each of the plurality of heating zones in the infrared radiator.

6. The method according to claim 5, wherein the plurality of heating zones have heating temperatures that increase sequentially.

7. The method according to claim 1, wherein in the Step S3, the matte tin-plated product is controlled to move at a constant speed along the movement path.

8. The method according to claim 1, wherein in the Step S3, the matte tin-plated product in each of the plurality of heating zones is heated to a predetermined temperature for a time period of less than 1 s.

* * * * *